United States Patent [19]

Schieser et al.

[11] Patent Number: 4,676,285

[45] Date of Patent: Jun. 30, 1987

[54] UNCAPPER FOR CONTAINERS HAVING FRICTION CAPS CARRYING FLEXIBLE TUBES

[75] Inventors: Warren J. Schieser, Dublin; Stanley E. Vickers, Hideaway Hills; Craig L. Duffey, Galena, all of Ohio

[73] Assignee: Liqui-Box Corporation, Worthington, Ohio

[21] Appl. No.: 876,013

[22] Filed: Jun. 19, 1986

Related U.S. Application Data

[62] Division of Ser. No. 718,150, Apr. 1, 1985, Pat. No. 4,620,411.

[51] Int. Cl.[4] ..... B65B 3/16; B65B 43/42

[52] U.S. Cl. ..... 141/114; 141/313; 141/166; 141/168; 141/98; 53/570; 53/381 A; 53/281; 53/469

[58] Field of Search ..... 53/50, 109, 381 R, 381 A, 53/384, 300, 281, 469, 468, 570; 141/10, 114, 313–317, 129, 165, 166, 168, 98

[56] References Cited

U.S. PATENT DOCUMENTS

| | | | |
|---|---|---|---|
| 3,087,518 | 4/1953 | Scholle | 141/83 |
| 3,242,951 | 3/1966 | Curie et al. | 141/350 |
| 3,516,220 | 6/1970 | Buford et al. | 53/300 X |
| 3,630,242 | 12/1971 | Schiesser et al. | 141/95 |
| 4,120,134 | 10/1978 | Scholle | 53/281 X |
| 4,250,691 | 2/1981 | Marshall | 53/381 A X |
| 4,283,901 | 8/1981 | Schieser et al. | 53/300 |
| 4,297,929 | 11/1981 | Schieser et al. | 53/300 |
| 4,363,338 | 12/1982 | Brown | 141/2 |
| 4,386,636 | 6/1983 | Ellert | 141/10 |
| 4,417,607 | 11/1983 | Scholle et al. | 141/1 |
| 4,446,674 | 5/1984 | Inada | 53/381 A X |
| 4,458,734 | 7/1984 | Scholle et al. | 141/5 |
| 4,481,753 | 11/1984 | Rutter et al. | 53/469 X |
| 4,510,737 | 4/1985 | Ellert | 53/570 |
| 4,620,411 | 11/1986 | Schieser et al. | 53/570 |

OTHER PUBLICATIONS

Rapak Bulletin—2 pages concerning "RP1200 Liquid Filler/Capper".

*Primary Examiner*—Stephen Marcus
*Assistant Examiner*—Ernest G. Cusick
*Attorney, Agent, or Firm*—William V. Miller

[57] ABSTRACT

A machine for automatically filling the capped spouts of flexible bags of a continuous strip which comprises a strip-feed section, a separated bag-feed section, a separator section and a filling and uncapping/capping section. The strip-feed section feeds the strip to the separator section where the leading bag is separated from the strip and is immediately advanced by the bag-feed section to the filling section. At the filling section, the bag is uncapped, filled and recapped.

11 Claims, 36 Drawing Figures

FIG. 4
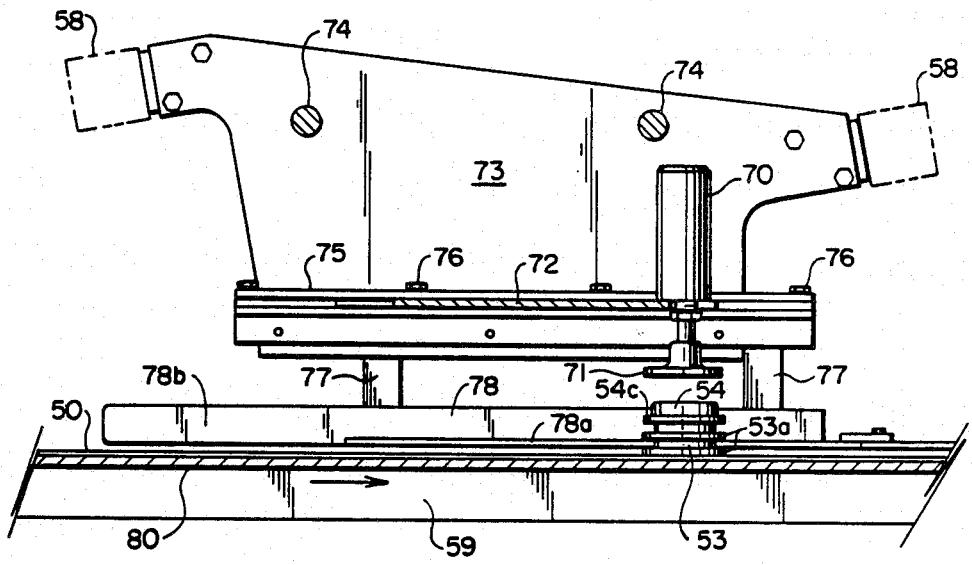
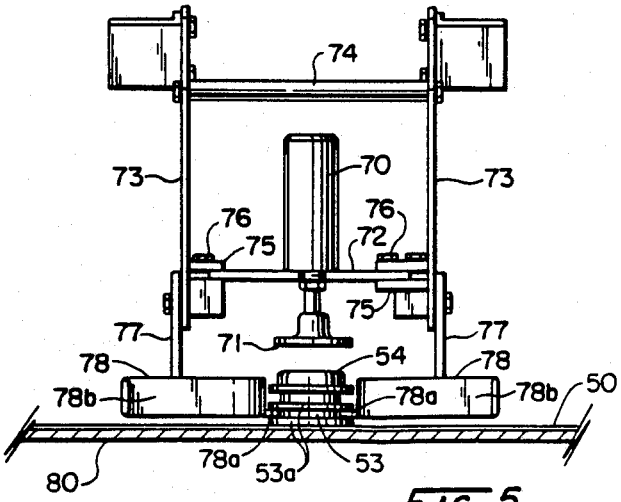
FIG. 5

IIC
IIC
63
64
78c
78c
78d
131
132
133
134
135
136
137
137a
138
139
140
140a
143
144
145
145a
145b
150
152
153
154
154a
156
157
158
158a
161
162
54

64
175
LV4
194
193
17
17
182a
LV7
191a
187
194
LV6
192
191a
191
182
16
150
LV8
176
171
165b
172
173
180
LV9
150b
150c
130
150a
196
183
166
13
13
190
190a
190a
186
189
156
157
16
158
158
158a
153
53a
162
54
53
154
55
158a

FIG. 13
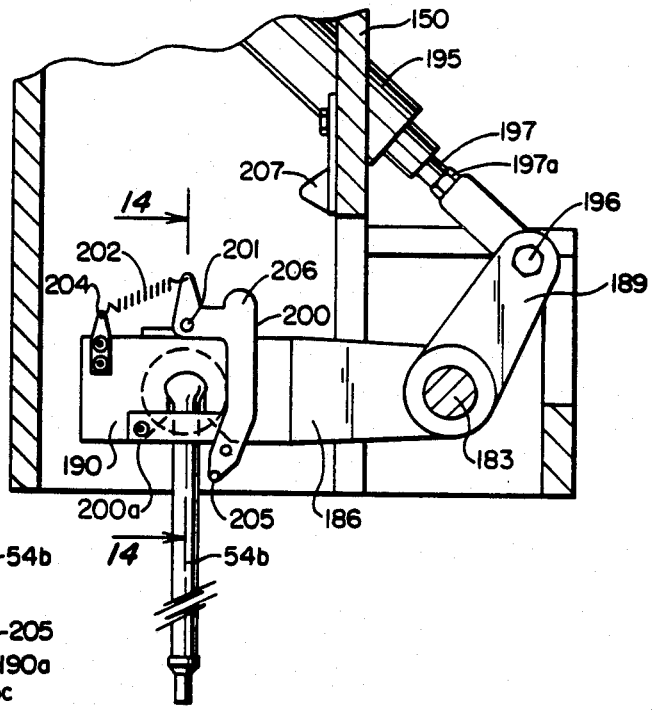
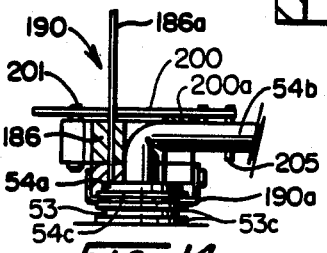
FIG. 14
FIG. 15
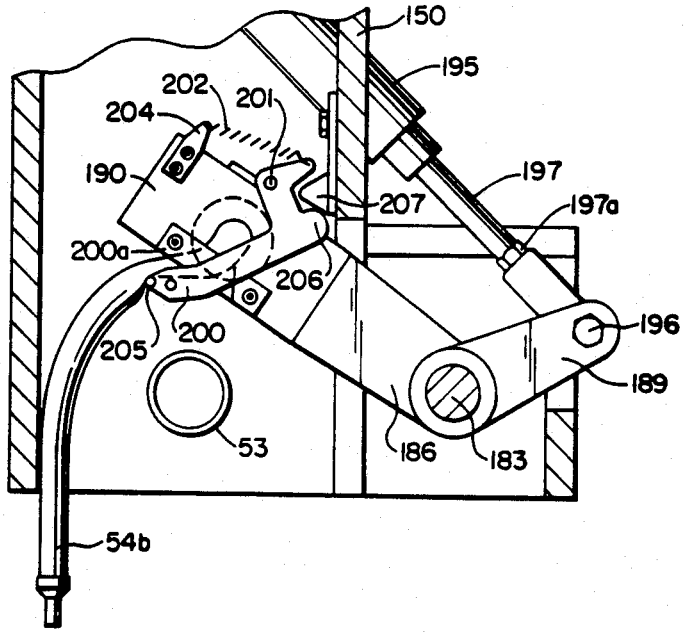

FIG. 16
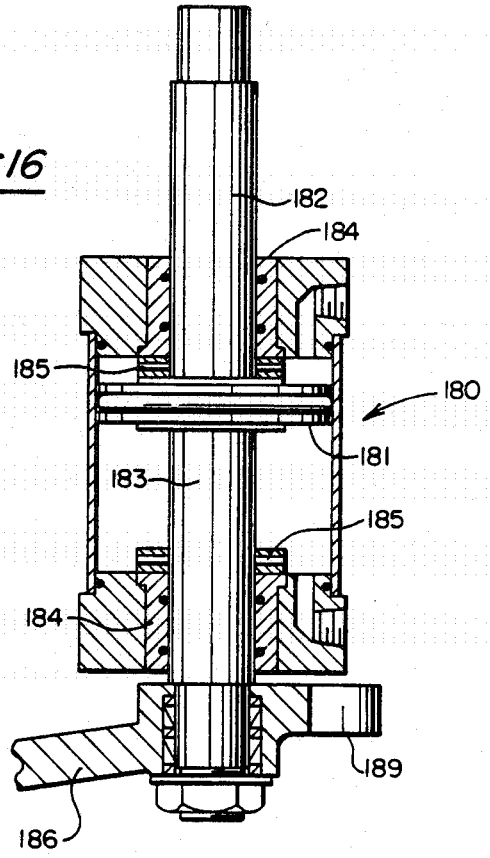
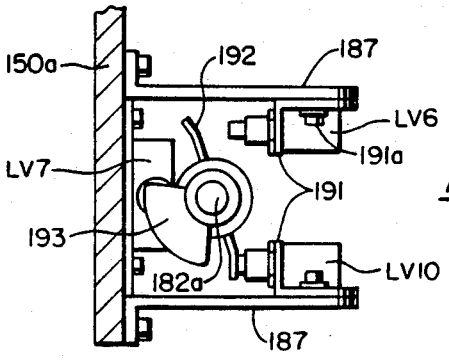
FIG. 17

66

57
216
218
216
215
213a
218
213a
19
19
211
213
212
213
210a
210b
214a
210
225
225
223
LVII
57b
222
224
224
221
57b
214a
223
214
214
57a
213
213
211
212
216
215
213a
210c
218
213a
216
218
57

66

57a
57b
LVII
57b
213
213a
213a
213
223
221
224
215
218
218
218
218
224
223
211
210a
210c
210b
212
222

UNCAPPER FOR CONTAINERS HAVING FRICTION CAPS CARRYING FLEXIBLE TUBES

This is a division of application Ser. No. 718,150, filed Apr. 1, 1985, now U.S. Pat. No. 4,620,411.

BACKGROUND OF THE INVENTION AND PRIOR ART

This invention relates to the filling of flexible bags which are supplied in the form of a continuous strip or web with transverse perforated lines at the intervals where the bags are to be separated. Each bag preferably is provided with a spout which carries a separable closure or cap that must be removed before filling and replaced after filling. The cap carries a flexible tube projecting upwardly therefrom. The filler of this invention automatically separates, uncaps, fills and recaps, the successive bags of the strip.

Machines for filling bags connected in a continuous strip or web have been provided in the prior art. In one type of filler in use, each bag lies on an inclined gravity roller section during filling which puts considerable strain on the spout and the bag.

Movement of the filled bag from the filling station is relied upon to pull the strip of bags along so that the next succeeding empty bag is moved to the station. This causes considerable stress on the strip and the bags thereof. In another type of prior art machine, the strip is advanced by air cylinder mechanism in a long stroke to advance the spout (and strip) placing the succeeding spout almost against the spout of the bag being filled; and a short stroke to advance the succeeding spout into fill position. In this type of machine, the strip of bags is wrinkled and crushed to form it into loops as it is fed to the filling station, which has detrimental effects on the bags of the strip. Another filler in the prior art receives a strip of bags without caps applied to the spouts thereof and applies separate caps after filling the bags. It is well recognized in the art that for sanitary reasons and to simplify the mechanics, the caps should be in place on the spouts as they are supplied to the filler.

SUMMARY OF THE INVENTION

The machine of this invention receives the flexible bags as a continuous strip or web with transverse perforated lines where the bags are to be successively separated. Each bag of the strip has a spout which carries a separable cap or closure of a type which carries a flexible tube. The machine of this invention automatically separates, uncaps, fills and recaps. the successive bags of the continuous strip. The machine is divided into five major sections: the strip-feed or long-feed section; the separator section, the separated bag-feed or short-feed section; the filling, uncapping, and capping section; and the discharge conveyor section. The long-feed draws the strip into the machine and advances it to a point that registers the perforated line with a separator blade. At this location, clamps hold the strip tightly as the separator blade breaks through the perforation. The spout of the bag to be separated is moved with the strip by the long-feed to a location where it will be separated and very rapidly transferred by the short-feed into an uncapping-capping mechanism directly under a fill-head. A sensor detects the presence of the spout and/or cap at the fill-head and actuates the spout clamping, uncapping and filling cycles. As the cap is raised and moved out of the way, the fill-head lowers and the filling commences under the control of a turbine metering system. As soon as the fill is completed, a fill valve closes, the head rises, the cap is placed on the spout and the spout gripper jaws are opened to release the filled bag. Simultaneously, a drop table in the form of a roller platform that supports the bag during filling, drops and the filled bag rolls by gravity onto the discharge conveyor, or optionally drops straight down into a container such as a shipping case or box. As soon as the capped bag clears the uncapper/capper, the following empty bag is transferred into the uncapper/capper by the short-feed; the filled bag is then carried away by the discharge conveyor. The uncapping-capping mechanism of this invention is designed to handle a flexible tube-bearing cap as well as a plain cap. One of the most important features of the machine of this invention is its handling of the bags without crunching or wrinkling, which would be detrimental to the barrier properties of some bag-film structures. The bags are transferred gently and lie flat continuously. The discharge of filled bags is highly variable to meet installation requirements in a variety of applications. With a short auxiliary conveyor, bags can be discharged on any of four quadrants from under the machine; or alternately, bags can discharge directly from the roller filling platform in any of the four quadrants with any desired bag edge leading: i.e., the spout-first or spout-trailing, and either side of the bag first. The latter is especially helpful in inserting bags into side-loading boxes or cases. A combination of pneumatic and electronic logic controls the program and monitors the machine operations.

BRIEF DESCRIPTION OF THE DRAWINGS

The best mode contemplated in carrying out this invention is illustrated in the accompanying drawings in which:

FIG. 4 is an enlarged vertical longitudinal section view of the cap seater of the machine taken along 4—4 of FIG. 2;

FIG. 5 is an enlarged transverse sectional view of the seater taken along line 5—5 of FIG. 2;

FIG. 13 is a horizontal sectional view taken along line 13—13 of FIG. 12 showing a different form of cap that carries a flexible tube and is removed from the spout and recapped according to this invention;

FIG. 14 is a sectional view taken along line 14—14 of FIG. 13;

FIG. 15 is a view similar to FIG. 13, but showing a different position of the uncapper/capper;

FIG. 16 is a vertical sectional view taken along line 16—16 of FIG. 12;

FIG. 17 is a horizontal sectional view taken along line 17—17 of FIG. 12;

DETAILED DESCRIPTION OF THE INVENTION

Figure 1:
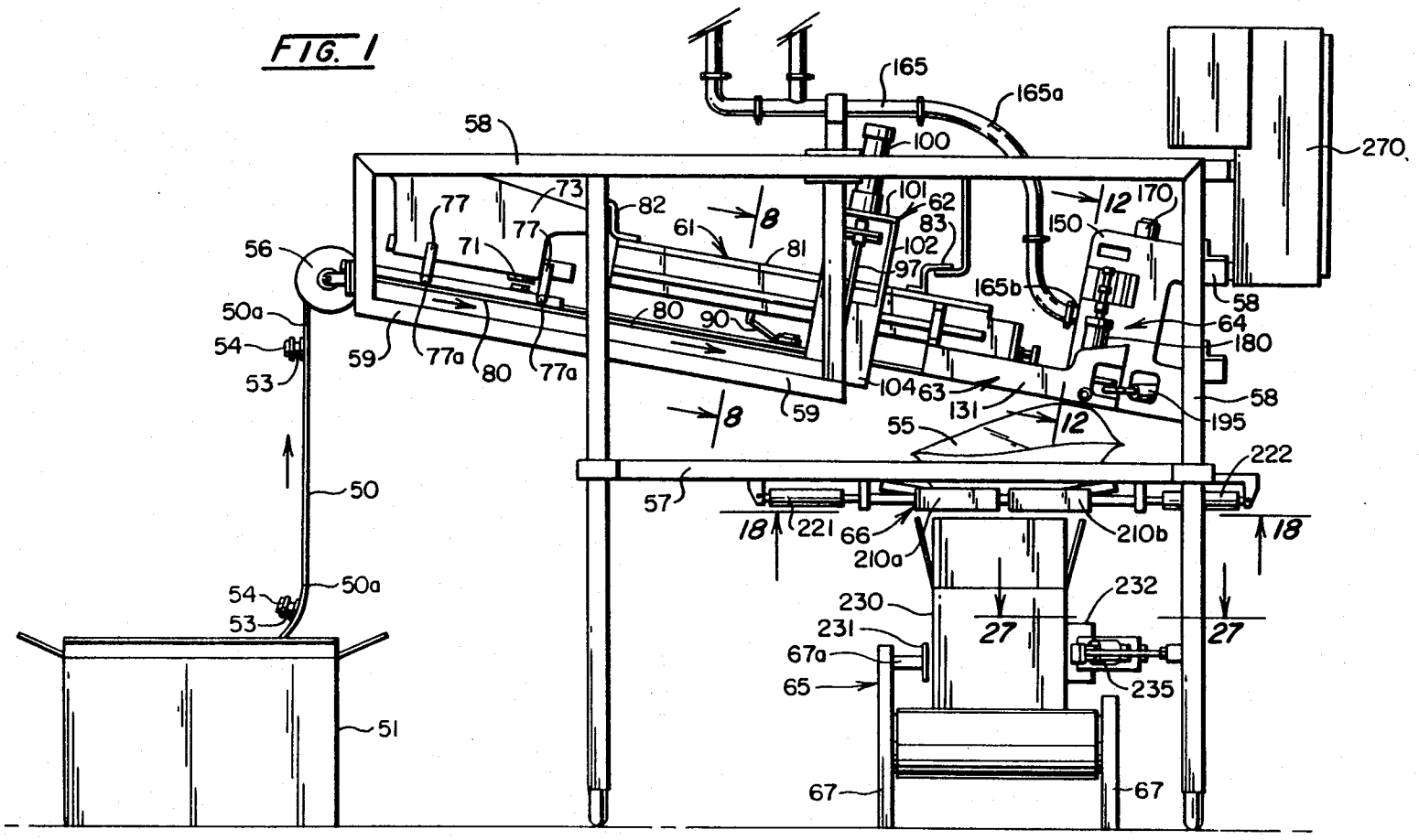
FIG. 1 is a side elevation view of the machine embodying this invention.

With reference to the drawings, the general arrangement of the machine of this invention is shown in FIG. 1. It receives a continuous strip of bags 50 which are pulled from a box 51 in which they are arranged in folded layers. At longitudinally spaced intervals, this strip is provided with transverse perforated lines 50*a* which are to be broken or cut by the machine to separate bags 55. Each bag 55 of the supplied strip 50 is provided with a spout 53 that carries a removable cap or closure 54 of any suitable snap-on type. The strip of bags 50 is passed over a transverse guide roller 56 which is supported at the front or in-feed end of the machine by the main support frame 58.

As indicated, the machine of this invention automatically separates, uncaps, fills and recaps the successive bags 55 of the strip 50. As shown in FIG. 1, the machine is divided into five major sections: the strip-feed or long-feed section 61; the separator section 62; the separated bag-feed or short-feed section 63; the filling and uncapping/capping section 64; and the discharge conveyor section 65. The sections 61, 62, 63 and part of the section 64 are supported by the main frame 58 at successive positions along a downwardly inclined sub-frame 59 of the main frame 58. The slideable drop table 66 of the section 64 is supported by a horizontal part 57 of the main frame 58. Below the bag support and discharge table 66 is the discharge conveyor 65 which is supported by a sub-frame 67.

The spouts 53 are shown arranged along the longitudinal center line of the strip of bags 50 but may be offset from it. Each spout 53 on each bag 55 is provided with the usual axially-spaced flanges 53*a* by which it can be handled as indicated in FIGS. 4 to 6 and 8 to 12. The snap-on caps on the spouts may be various types such as the simple closure type 54 shown in FIGS. 1, 4 to 6, and 8 to 12. Or the caps may be of the type indicated at 54*a* in FIGS. 13 to 15, which carry a flexible tube. In each case, the cap usually will be provided with a flange 54*c* by which it can be handled.

As the strip of bags 50 is pulled over the idler friction-reducing in-feed roller 56 of the long-feed 61, the bag strip is straightened and proceeds toward the filling position in section 64. It is first subjected to a cap seater which presses the cap 54 on each successive spout 53 to a pre-determined down position to prevent jam-ups due to caps that may not be seated properly. This cap seater is shown best in FIGS. 1, 4 and 5. It comprises a vertically-disposed pneumatic cylinder and piston unit 70, the piston rod of which has a disc-like or suitably shaped foot 71 for engaging the upper surface of the cap or closure. This cylinder and piston unit is carried by a horizontal mounting plate 72 which is disposed between a pair of laterally-spaced vertically disposed stand-off support plates 73, which are arranged in longitudinal parallel relationship at each side of the longitudinal center line of the machine. The depending plates 73 are supported at their upper edges by the main frame 58 and are spaced by transverse spacer rods 74. Each of the plates 73 is provided on its inner surface with a longitudinally extending horizontal guide 75 for receiving the adjacent edge of the plate 72 and the plate may be adjusted therealong and clamped in adjusted position by clamp bolts 76. This adjustment is necessary when the machine is supplied with strips that have different bag lengths. The plates 73 also support depending brackets 77 which carry in an inclined position at their lower ends, the parallel longitudinally extending spout guides 78. These spout guides are carried on the lower ends of members 77 by adjustable bracket units 77*a* for adjustment laterally of each other and each carries at its lower edge a tongue 78*a*, which extends between the flanges 53*a* of each spout 53. The guides 78 are provided at the inlet ends with converging guide throat portions 78*b*. Below the spout guides 78, a bag strip support plate 80 is provided and is supported in an inclined position along the inclined part 59 of the main frame 58. The strip of bags 50 will be pulled along the support 80 so as to move the successive spouts 53 through guides 78 into alignment with the cap seater foot 71, at which time the cylinder and piston unit 70 will be actuated to press the cap 54 down to a pre-determined position on the spout 53. The spout guides 78 can be adjusted laterally to receive spouts of different diameters.

Figure 6:
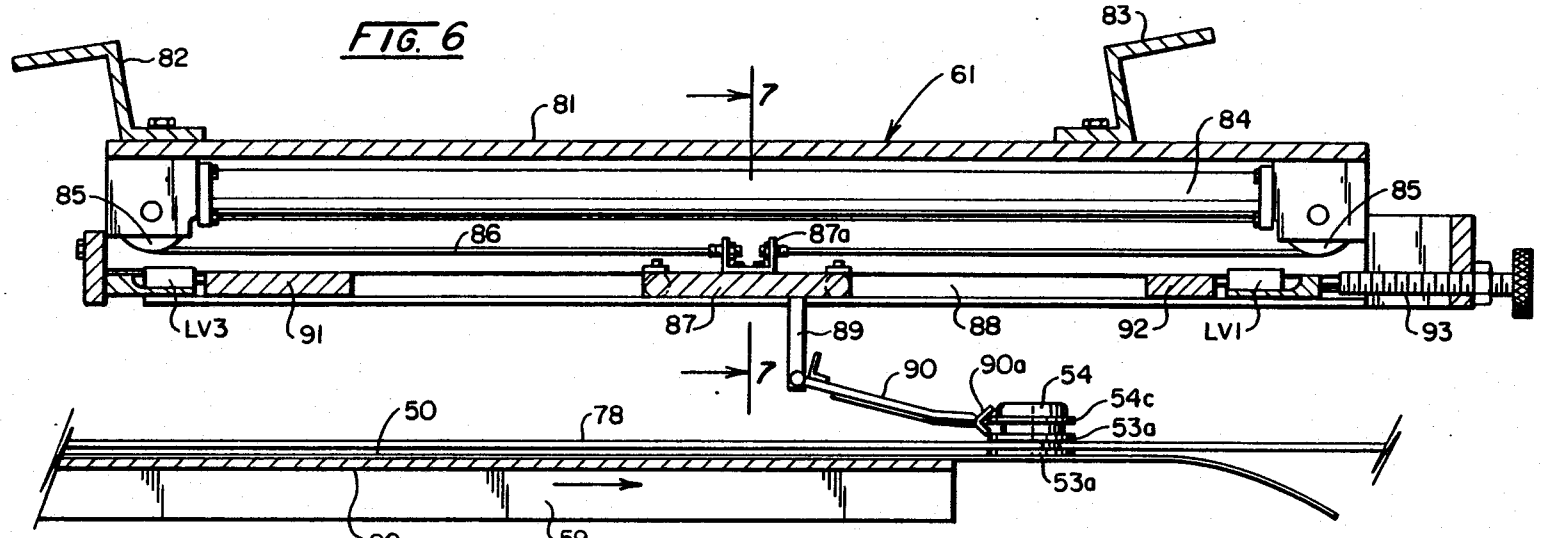
FIG. 6 is a longitudinal vertical sectional view taken along line 6—6 of FIG. 1 showing the long section.
Figure 7:
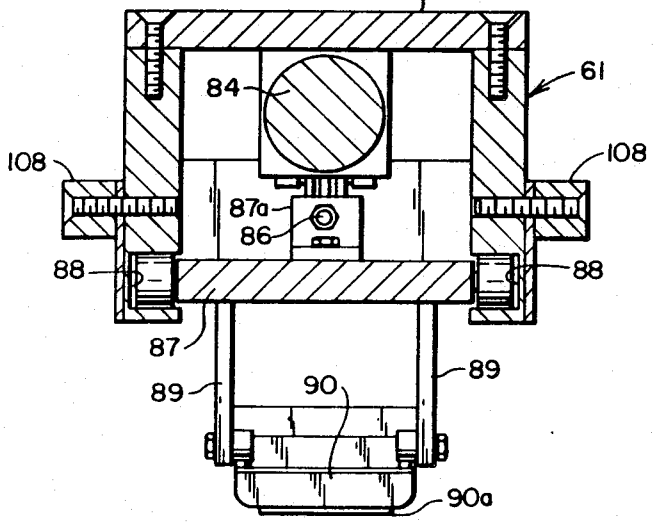
FIG. 7 is a transverse vertical sectional view taken along line 7—7 of FIG. 6.
Figure 8:
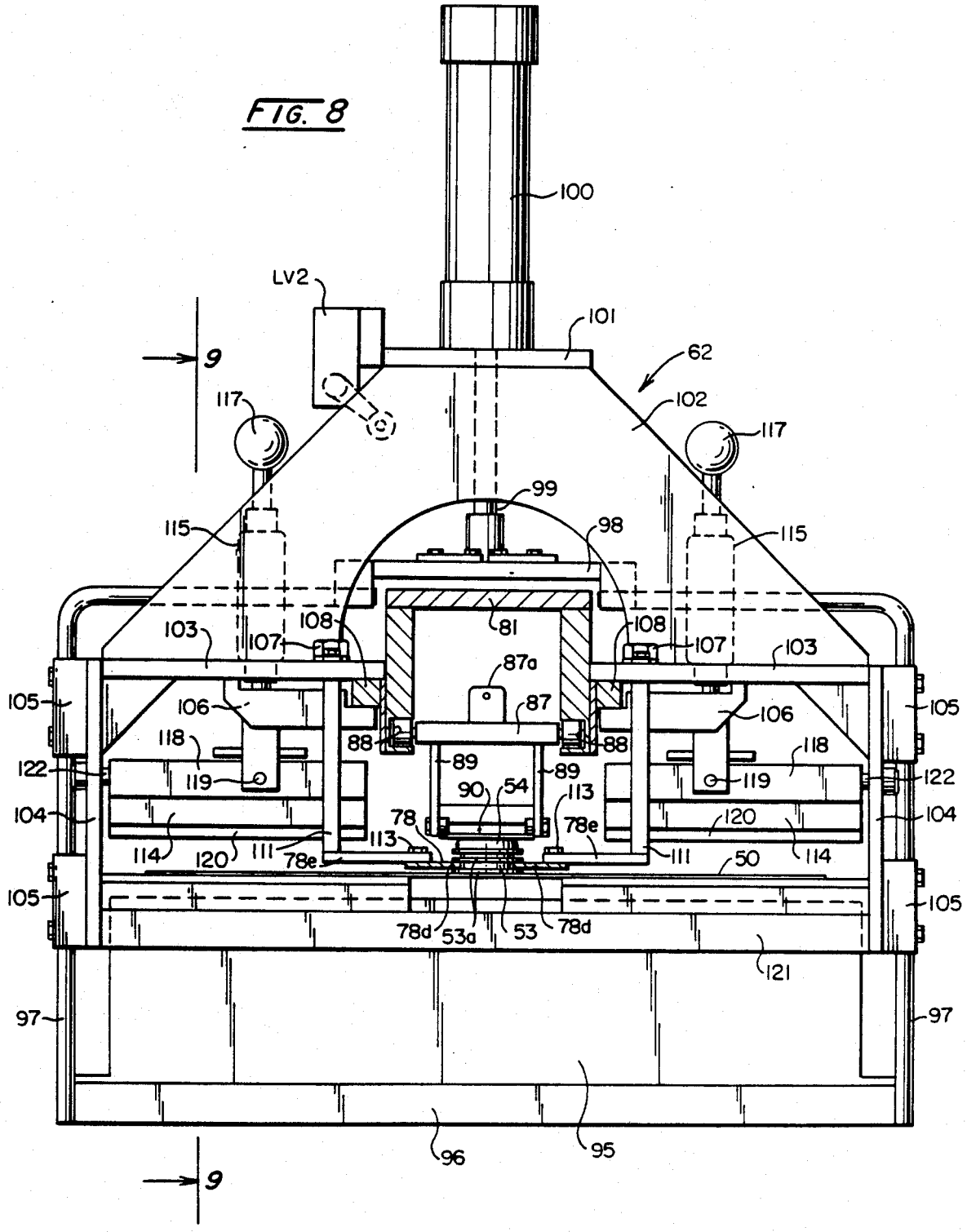
FIG. 8 is an enlarged transverse vertical sectional view taken along line 8—8 of FIG. 1 through the separator section.
Figure 9:
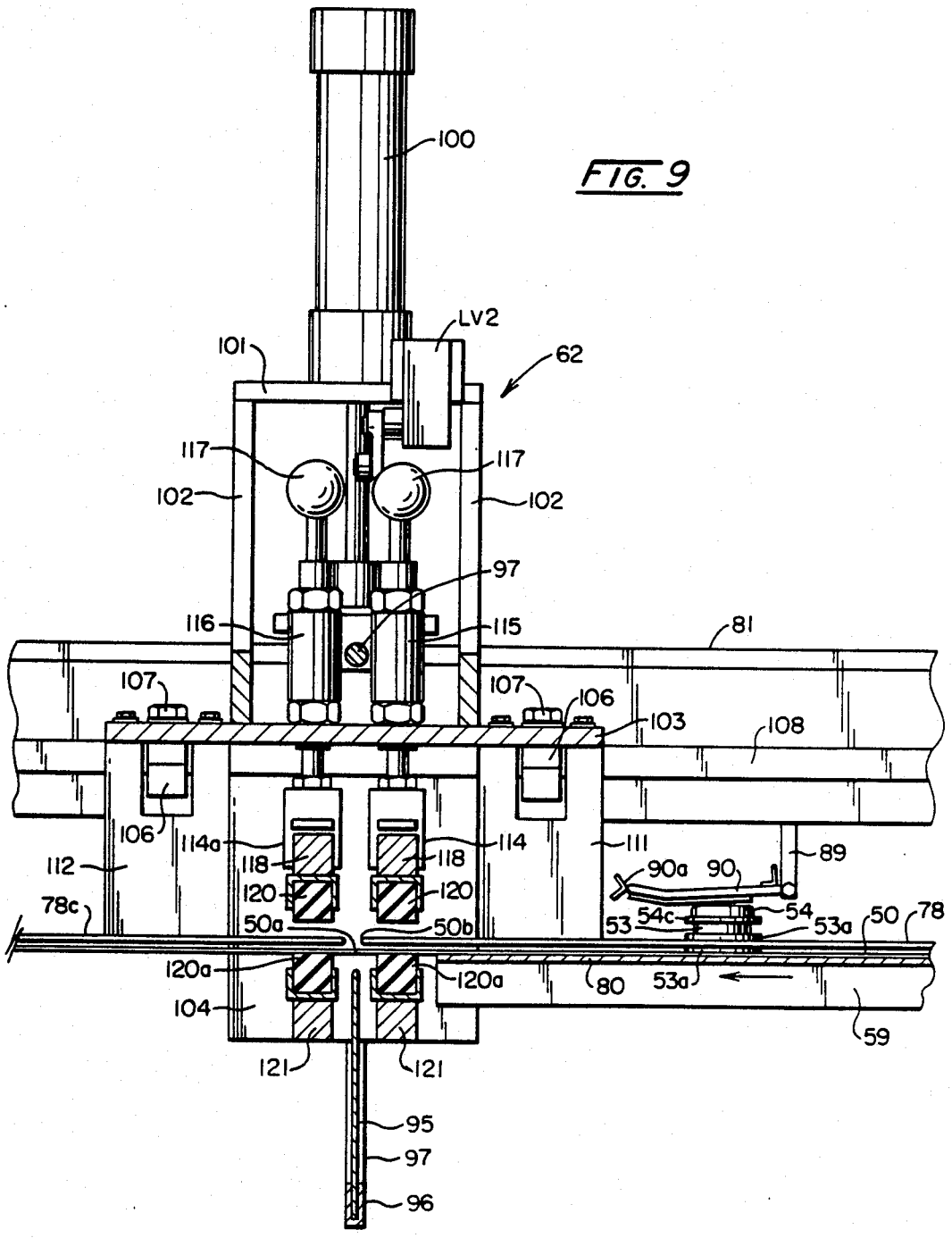
FIG. 9 is a longitudinal vertical sectional view taken along line 9—9 of FIG. 8 through the separator section.
Figure 10:
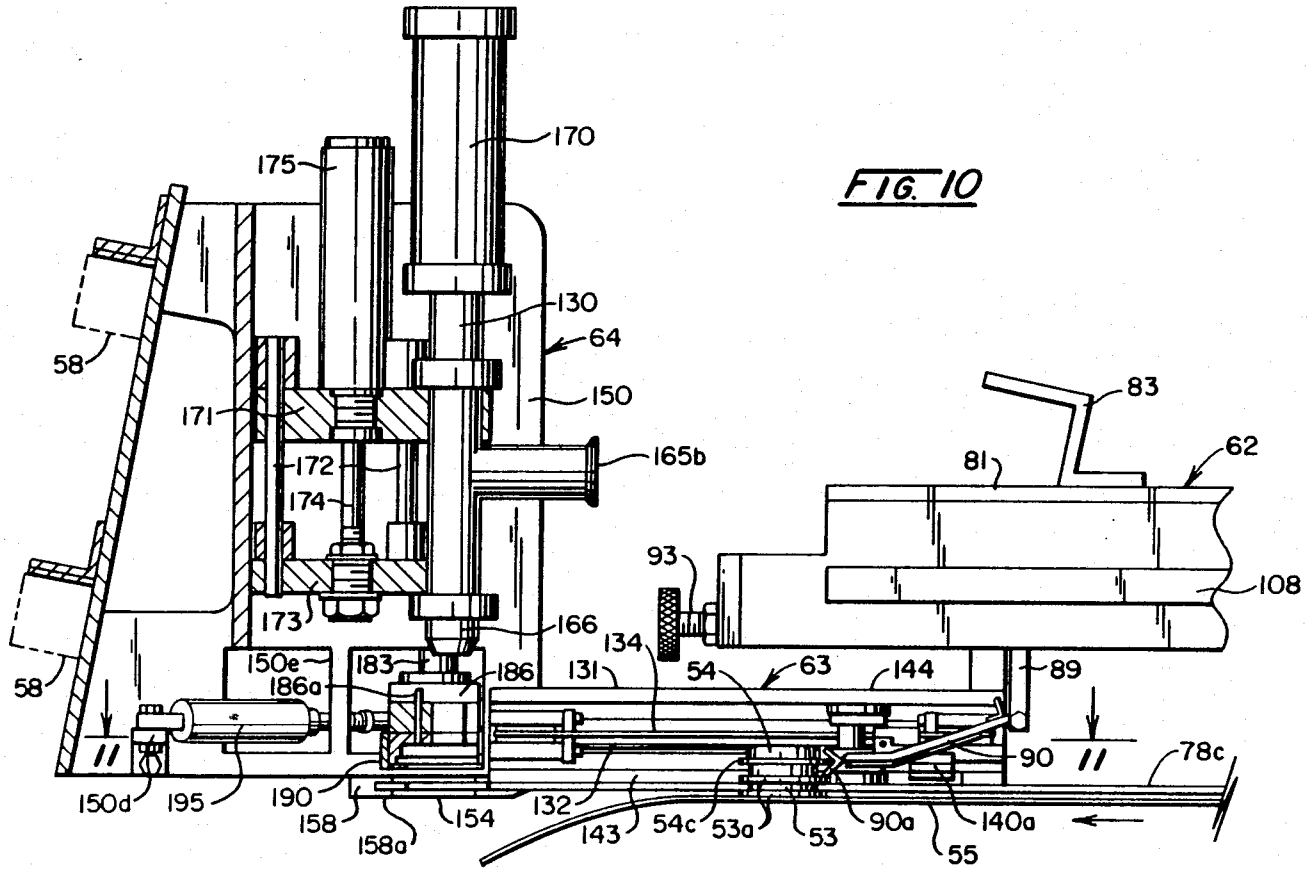
FIG. 10 is an enlarged longitudinal vertical sectional view taken along line 10—10 of FIG. 2 through the short-feed and filler uncapper/capper sections.
Figures 11, 11A, 11B, 11C:
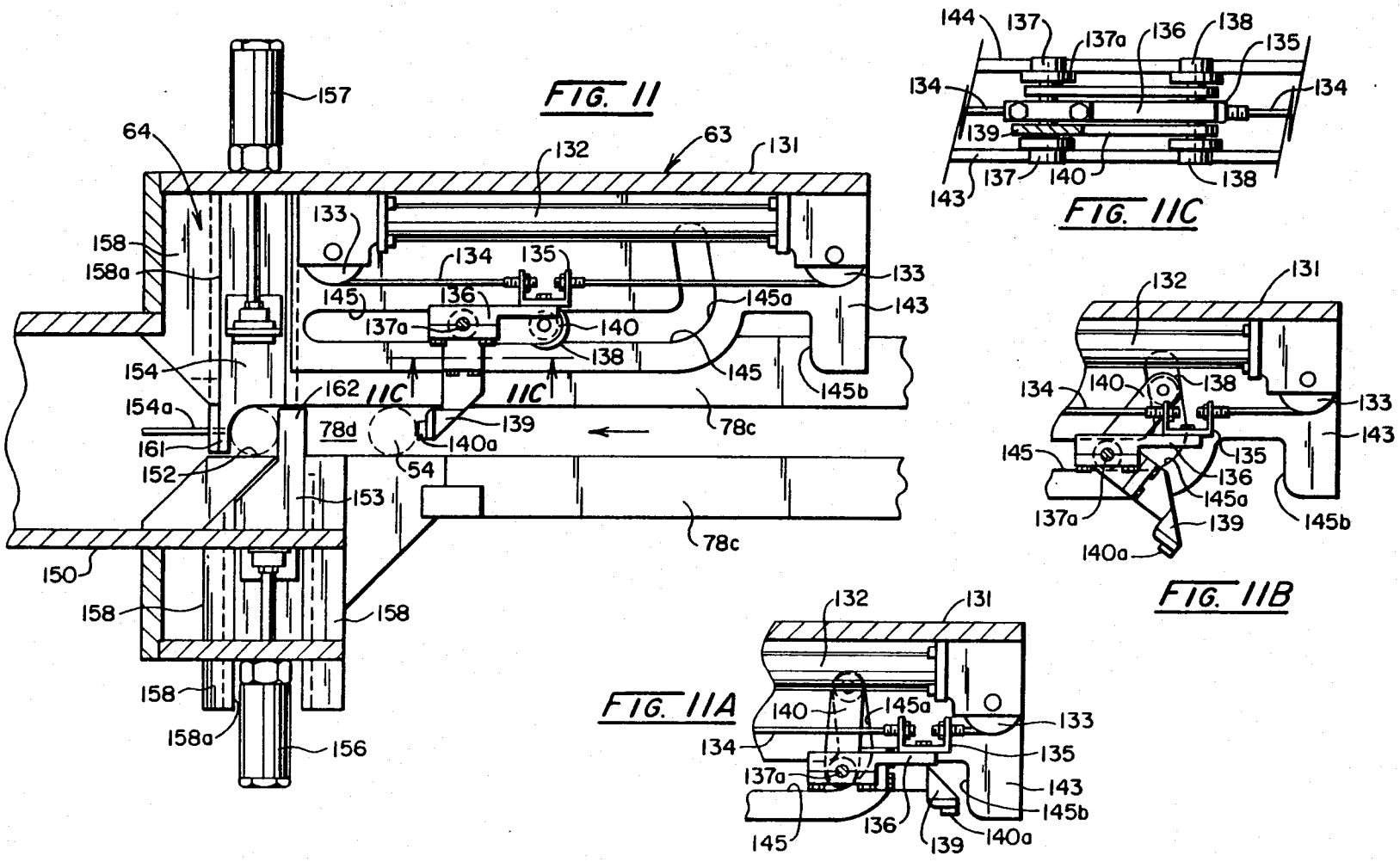
FIG. 11 is a longitudinal horizontal sectional view taken along line 11—11 of FIG. 10.
FIG. 11A is a sectional view taken from FIG. 11 showing the retracted position of the spout pusher of the short-feed.
FIG. 11B shows an intermediate position of the pusher.
FIG. 11C is a sectional view taken along line 11C—11C of FIG. 11.

The strip-feed or long-feed 61 for the strip of bags 50 is shown best in FIGS. 1, 2, 6 and 7 and comprises a cable cylinder and piston in inverted channel-like housing 81. It is supported in an inclined position so as to be parallel to and above the strip support plate 80 by means of brackets 82 and 83 which are supported from main frame 58. The pneumatic cable cylinder 84 has the pulleys 85 at its opposed ends around which the cable 86 passes; this cable has its ends connected by U-shaped clip 87*a* to a four cam-roller car 87 or carriage running in enclosed tracks 88, which are bolted to each side of housing 81 (FIG. 7). Brackets 89 depend from this car and have a spout engaging bail 90 pivoted to their lower ends for vertical swinging movement, which has an angular lip 90*a* for engaging cap flange 54*c* (FIG. 6). On the feed stroke (FIG. 6), the bail 90 contacts the capped spout 53 to advance the strip of bags 50 by pushing on the capped spout, and on the return stroke, this bail rides over the capped spout and drops behind the following bag spout.

Limit valves LV3 and LV1 are located in the opposite ends of long-feed housing 81. These valves are actuated at each end of the stroke. The valves are actuated by slideable contact blocks 91 and 92, which ride in the car tracks 88 so that any change of stroke of feed bag travel, which will be adjusted in accordance with spout spacing for various length bags is automatically compensated for, requiring no valve operating point adjustment. At its one end, the housing 81 carries a threaded stop screw 93 with which the slide block 92 engages when pushed to its final position on the feed stroke. This adjustment is used to accurately determine the forward stroke of the long feed so as to register the successive perforated lines 50*a* of the bag strip with the blade of the separator 62. It will be noted from FIG. 6 that the bag strip support plate 80 terminates just short of the downstroke end of the long-feed section 61.

The separator 62 is located towards the lower end of housing 81 and is movable to different positions therealong in accordance with bag length. It is shown best in FIGS. 1, 8 and 9, and includes a vertically reciprocable blade 95 that operates on its upstroke to cut or tear the bag strip 50 at its successive transverse perforated lines 50*a*. The blade 95 is carried by the transverse support 96 connected to the lower ends of inverted L-shaped guide rods 97. The upper ends of these rods are turned inwardly toward the long-feed housing 81 and are connected to a horizontal bracket 98 which is just above the housing when the blade 95 is in its lowermost position. This bracket 98 is connected to the lower end of the piston rod 99 extending downwardly from the air cylinder 100 which produces vertical movement of the blade 95. This cylinder 100 is upstanding on a horizontal support plate 101 which is disposed substantially above the housing 81 and is supported by upstanding longitudinally spaced transverse yoke-like plates 102. The plates 102 are supported at opposite sides of the housing 81 by the horizontal support plates 103, which are carried by laterally spaced upstanding stand-off plates 104 and housing 81, which has longitudinal side strips 108 to which it is clamped by clamp members 106 and bolts 107. These plates 103 can be adjusted longitudinally along housing 81 by releasing and reclamping clamps 106.

The plates 104 are provided on their outer surfaces with the vertically spaced slide bearings 105 which receive the guide rods 97 for vertical movement. This movement is accomplished by actuating the air cylinder 100 to move the blade 95 upwardly from its lower position in FIG. 8 to sever the strip of bags 50. Return movement of the blade is accomplished when valve LV2 is actuated. This valve is supported by plate 101 and is engaged by plate 98 upon completion of the upstroke of the cylinder. From the support plates 103 (FIG. 9) a pair of front stand-off plates 111 and a pair of stand-off plates 112 are provided and the clamps 106 extend through these plates. The front plates 111 support the spout guides 78 at their adjacent ends. The rear plates 112 support a continuation 78*c* of the spout guides 78 and are spaced therefrom at 50*b* to permit passage of blade 95. Also, the plate 80 terminates short of this point to permit passage of blade 95. The guides 78*c* include the spout engaging tongues (FIG. 8) 78*d*. The tongues 78*d* are connected to the guides 78*c* by slot and bolt connections 113 to permit lateral adjustment to receive spouts of various diameters.

At the separator section 62, clamps hold the strip of bags 50 tightly as the blade 95 breaks through the perforated line 50*a*. These clamps (FIG. 9) comprise a pair of front clamps 114 and a pair of back clamps 114*a* which are spaced on opposite sides of the space 50*b* through which the blade 95 passes. The clamps 114 are nearest the in-feed of the machine and the clamps 114*a* are beyond the path of reciprocation of the blade 95. The clamps of each pair are located on opposite sides of the long-feed housing 81. The front clamps 114 are actuated by a pair of air cylinders 115 and the back clamps 114*a* are actuated by a pair of rear cylinders 116, all of which have knobs 117 for convenience in manually moving cylinder rods. Each clamp includes a cross bar 118 which is pivotally suspended from the pivot rod 119 for lateral tilting. Each bar 118 carries a yieldable, such as rubber, strip-engaging contact block 120. Each clamp is guided in its transverse position by a guidepin unit 122 which operates in a vertical slot in the adjacent plate 104. Directly below the spout guides 78 and 78*c* in alignment with the blocks 120 are similar cooperating stationary contact blocks 120*a*, each of which is supported by a clamp bed 121. The clamp beds 121 extend transversely and are supported at their ends by the plates 104 to which they are rigidly fixed. The clamp cylinders 115 and 116 are actuated at the proper times to clamp the bag strip while it is being severed at the perforated line 50*a*.

The capped spout of the separated bag 50 is now in location where it will be engaged by the short feed section 63 for advancement into the uncapping/capping mechanism directly under the fill-head 130 (FIG. 10) of the filling section 64. The short feed section 63 is shown best in FIGS. 1, 10, 11, 11A, 11B, 11C and 12. The short-feed section is disposed in a housing section 131 which extends downwardly from and below the long-feed section housing 81. The mechanism of this section includes an air operated cable cylinder 132 carried within the housing 131, which has the pulleys 133 at opposite ends around which the cable 134 passes. The ends of this cable are connected by a U-shape clip 135 to a reciprocable coupler 136 which couples the cable to the short-feed car or carriage 140. Coupler 136 includes a pivot axle shaft 137*a*. Car 140 is a bell crank lever which has on its inner end a cam roller 138 and on its outer end cam rollers 137 and a cap-engaging arm 139 with a lip 140*a*. for engaging the cap flange 54*c*. Car 140 is pivoted on axle shaft 137*a* of coupler 136.

The vertically spaced cam rollers 137 and 138 operate in a bottom cam plate 143 and a top cam plate 144 which are a part of the U-shaped cross-section housing 131. Each of the cam plates has a roller-receiving cam slot 145 of identical form and in exact vertical alignment with each other. The slots have a main straight section which extends longitudinally, but the front end of each is provided with a sharp lateral bend 145*a* toward cylinder 132. Also, the adjacent edge of lower plate has a notch 145*b*. In the position shown in FIG. 11, the lip 140*a* is in engagement with the cap flange 54*c* of cap 54 because roller 138 is in the straight section of cam slot 145, whereas in FIG. 11*a*, it is swung to a position out of engagement therewith. This swinging is accomplished by roller 138 moving into the lateral position 145*a* (FIG. 11A) of the cam slot and swinging the member 140 about the axis of axle shaft 137*a* to one side of the spout track provided by the guides 78*c* at the same time arm 139 moves into notch 145*b*. The short-feed 63 moves the separated bag 55 with the capped spout to the uncapping/capping mechanism directly under the fill-head 130 of the filling and uncapping/capping section 64. A pneumatic sensor arrangement detects the presence of a capped spout in position for clamping and uncapping. The spout sensor is comprised of a horizontal nozzle 154*a* (FIG. 11) located in back spout clamp 154, flexible tubing connecting the nozzle to an adjustable air pressure source and a branch of the tubing connected to a back pressure sensing pneumatic control module. With no spout interrupting the free flow of air at the nozzle, minimal back pressure is generated at the pneumatic control module. Conversely, a spout interrupting the air flow generates back pressure actuating the control module. Similarly, a vertical cap sensor nozzle 186*a* (FIG. 14) is directed downwardly through the cap chuck to detect the presence of a cap on the clamped spout.

This section 64 is shown best in FIGS. 1, 2, 10, 11 and 12. It is supported by an upstanding mounting bracket-unit 150 which is carried by cross members of the frame 58 in rearwardly tilted position (FIG. 1). Its lower end is connected to the short-feed housing 131. This bracket supports the filler-head 130 previously mentioned and the uncapping/capping mechanism to be described.

From the guideway provided by the spout guides 78*c* of short-feed 63, the capped spout is pushed into a terminal guide section 78*d* which is formed in a base plate 158 of the mounting bracket 150. This guide section has an open wide outlet end at 152 to which the capped spout is pushed by the short-feed pusher 140*a* and at which point, the sensor is actuated. At this point, the short-feed pusher is retracted and the spout is locked in position by front and back latches or clamps 153 and 154, which are slidably mounted on the base plate 158 in guides 158*a* for transverse reciprocal movement towards and from each other. The clamp 153 is reciprocated by cylinder and piston unit 156 and the clamp 154 is reciprocated by cylinder and piston unit 157 which are mounted (FIG. 11) on the mounting bracket 150 with their axis in opposed horizontal relationship. The clamp 154 has a spout-gripping jaw 161 which will move between the spout flanges 53*a* and the clamp 153 has a spout-gripping jaw 162 which will move horizontally between these flanges. The clamp 154 will be actuated first to engage and stop the capped spout and then then the clamp 153 will be actuated to firmly engage and grip and lock the capped spout in position in vertical axial alignment with the fill-head 130. It will be noted from FIG: 12 that the spout-engaging jaws 161 and 162 of the clamps are of reduced thickness to coincide with spacing of the spout flanges 53*a*. At this time, the bag will usually be supported on platform 66.

The fill-head 130 is mounted for vertical reciprocation on the support bracket 150. It is shown best in FIGS. 2, 10 and 12 receives the liquid or semi-liquid for filling the bags 55 from a supply conduit 165 (FIGS. 1 and 2) which includes a flexible section 165*a* to permit the vertical movement of the fill-head and which will be connected to the fill-head at inlet 165*b*. The fill-head preferably is of the air-operated low turbulence type with a foot valve in the nozzle 166 at its lowest extremity. Metering of the liquid is preferably by digital turbine meter near the fill-head, but other types of flow meters may be used. This meter generates a digital (pulsed) output proportional to the volume of the liquid and supplies pulses to a counter to be later identified, which controls the closing of the fill valve when the pre-set quantity is reached. The fill-head 130 includes the upstanding cylinder and piston unit 170 in which the piston and associated mechanism for operating the fill-head valve are located. The fill-head is carried for vertical movement by the vertically movable plate 171 which travels on vertical guide rods 172. These rods are upstanding from a fixed horizontal support plate 173, which is supported by upstanding walls 150*a* and 150*b* of the support bracket 150. The fixed plate 173 is connected to the piston rod 174 (FIG. 10) of the cylinder and piston unit 175, which controls vertical movement of the fill-head. The cylinder of unit 175 is mounted on the vertically movable plate 171 for movement therewith. At the time the fill-head 130 is in its upper position, the capped spout 53 has been moved into position therebeneath and is latched or clamped into position by actuation of the cylinders 156 and 157. A limit valve LV8 (FIG. 12) is supported on the bracket 150 so that it will be engaged by a trigger clip 176, carried by the movable plate 171, when it reached its upper position. Similarly, a limit valve LV9 is carried by the plate 150*b* for engagement by trigger clip 176 when the plate 171 is in its lowermost position. The stroke of the cylinder and piston unit 175 will be controlled in this manner.

Figure 12:
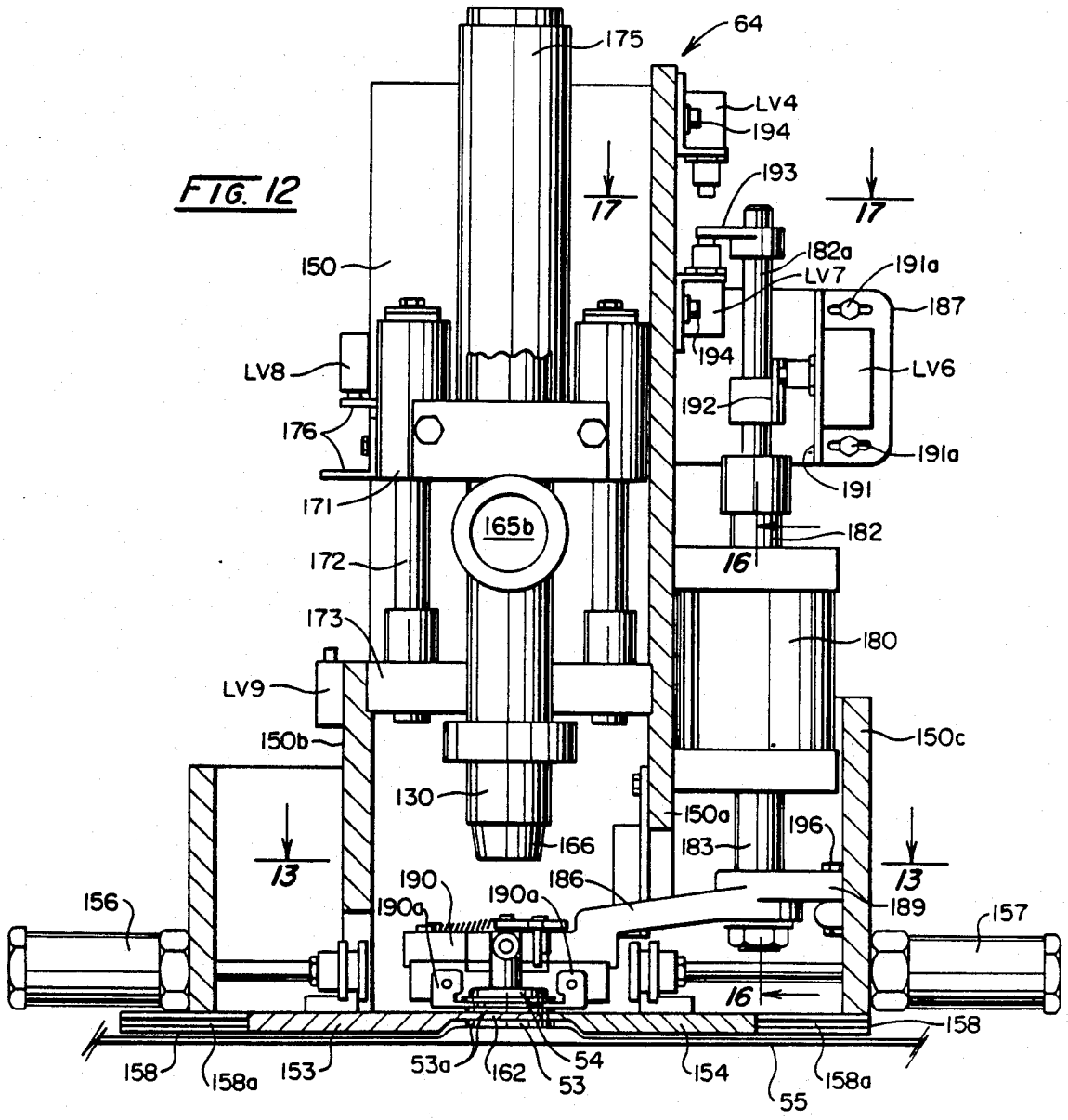
FIG. 12 is an enlarged transverse vertical sectional view taken along line 12—12 of FIG. 1 through the filler section and showing the uncapping/capping mechanism and fill valve.
Figure 18:
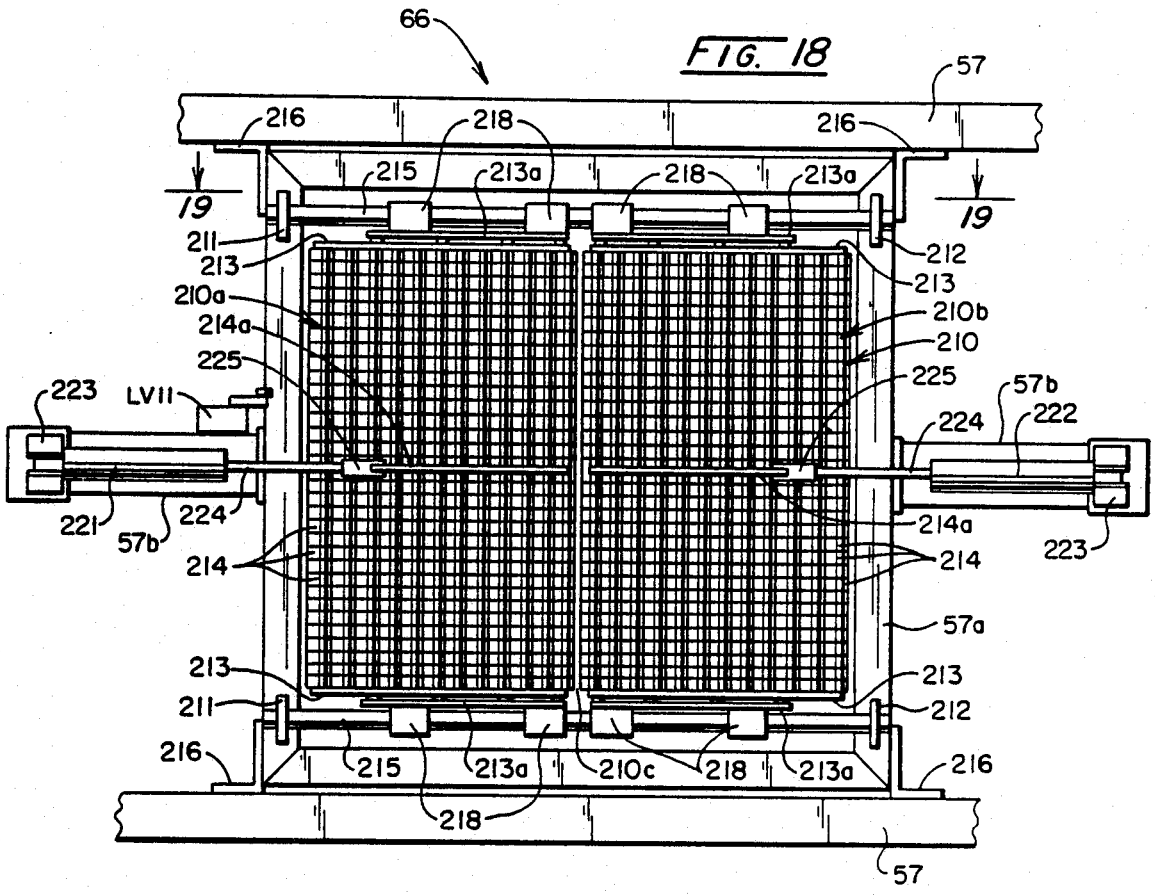
FIG. 18 is an enlarged horizontal section view taken along line 18—18 of FIG. 1 showing the drop table at the filler section.
Figure 19:
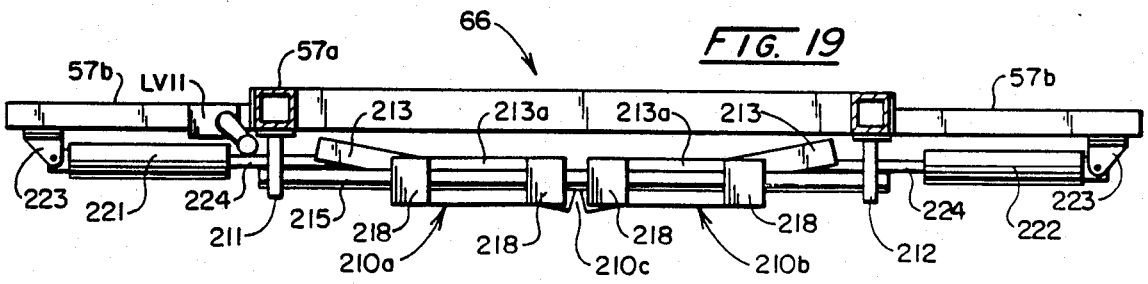
FIG. 19 is a vertical sectional view of the drop table taken along line 19—19 of FIG. 18.

The uncapping/capping mechanism acts on the cap 54 of the spout 53 which is clamped in the fill position shown in FIG. 12 by the clamps 153 and 154. The uncapping and capping of the spout takes place at this station by raising the cap to pull it off spout 53 and pivot it out of the path of the downwardly moving fill-head nozzle 166 which fills the bag 55 under control of the metering system. As soon as the fill is complete, the fill valve closes and the fill-head rises, the cap is swung back over the clamped spout and moves down to cap the spout of a filled bag. The capper pivot arm 186 then swings back stripping the chuck from the cap. The spout gripper jaws 161 and 162 are separated to release the filled bag. As soon as the recapped bag is released, the capper arm 186 pivots forward, the back clamp 154 extends and the following empty bag is transferred to and clamped in the fill position.

The uncapping/capping mechanism is shown best in FIGS. 1, 2, 10, 12 to 17 and for simplicity, it will be referred to as the capping mechanism. It includes a cylinder 180 (FIG. 12) which is mounted in a fixed vertical position between wall 150*a* and an upright wall 150*c* of bracket 150. The cylinder has a piston 181 (FIG.

16) on a rod which has an upstanding section 182 and a depending section 183. These rod.sections extend through the opposed heads of the cylinder and bearings 184 are provided therein which permit sliding and rotation of the rod sections. Thrust bearings 185 are also provided within the heads.

The lower end of the depending rod section 183 has clamped thereon the previously mentioned radially-extending capper pivot arm 186 which has the forwardly-opening cap chuck 190 on its outer end and has crank extension 189 on its inner end. The upstanding rod section 182 carries an upward extension 183*a* which is associated with a bracket 187 (FIG. 12) which projects outwardly from the wall 150*a* and has a pair of limit valve mounting brackets 191 mounted by bolt and slot connections 191*a* for adjustment towards and from the wall. These brackets 191 (FIG. 17) are disposed on opposite sides of extension 182*a* of rod 182 (FIG. 17) and carry limit valves LV6 and LV10 which are actuated by a relatively vertically movable and rotatable contact member 192 carried on the rod extension 182*a* for vertical and rotative movement therewith. The upper end of the rod extension carries a fan-shaped contact 193 which travels vertically between and alternately operates the limit valves LV4 and LV7 to control the stroke of the capping cylinder 180. The valves LV4 and LV7 are carried on wall 150*a* for vertical adjustment by means of bolt and slot connections 194 and provide inputs to the control system which along with other logic functions control the capper pivot cylinder 195, capper cylinder 180, fill valve cylinder 175 and others, as will be described later. Valves LV6 and LV8 provide inputs for controlling a cylinder and piston unit 195 (FIG. 10 & 13), which produces forward and rearward swinging of chuck-carrying arm 186, as well as other functions.

The crank extension 189 of cap chuck-carrying arm 186 is pivoted at 196 to the piston rod 197 of the cylinder piston unit 195 that controls swinging of the arm 186 about its pivot 183. The cylinder of unit 195 will swing through limited movement vertically with the chuck-carrying arm 186 and is positioned for this vertical movement in an opening 150*e* (FIG. 10) in the side wall of mounting bracket 150. This cylinder of the unit 195 is (FIG. 10) pivotally mounted on a rearward extention 150*d* of mounting bracket 150 for vertical swinging movement. Rod 197 is provided with a threaded connection 197*a* so its length can be adjusted to accurately determined the forward position of the cap chuck 190.

As indicated, the cap chuck 190 is on the outer end of arm 186. The chuck has an insert 190*a* on its lower edge which provides opposed cap-engaging lips or flanges (FIGS. 12 and 14). If the cap is a plain flanged cap of the type previously referred to as cap 54, the cap chuck 190 will merely engage the cap below flange 54*c*. If a tube-bearing cap of the type indicated at 54*a* in FIG. 14 is being used, in accordance with the invention the tube 54*b* must first be bent down and deflected laterally. As indicated, the inwert 190*a* on cap chuck 190 at the lower edge of the arm 186 provides opposed flanges or lips (FIG. 14) which engage beneath cap flange 54*c* on the cap 54 or cap 54*a* and above upper spout flange 53*a*. At the upper side of the chuck 190 at its inlet a transverse plate 200*a* is fixed for engaging the upstanding tube 54*b* as the cap enters the chuck to bend it downwardly The deflecting attachment needed for deflecting the downwardly bent tube 54*b* on cap 54*a* is shown in FIGS. 13 to 15 and comprises the tube deflector in the form of a bellcrank lever 200 pivoted for horizontal swinging the rear edge of arm 186. As a tube cap is pushed into the rearwardly positioned chuck 190 (FIG. 13), the tuoe strikes plate 200*a* bending it from vertical to horizontal position (FIG. 14). Simultaneously, the lips of insert 190*a* enter the slots formed between the cap lift flange 54*c* and upper spout flange 54*a*. A spring 202 connects to the inner end of deflector 200 and is anchored at 204 to the chuck-carrying arm 186 and normally keeps the member 200 in a non-deflecting position as shown in FIG. 13. This deflector 200 at its outer end is provided with depending tube-engaging means interform of means in the form of pins 205 which engage, the tube 54*b* to deflect it when the deflector 200 is in the position shown in FIG. 15. In this latter position, a lug 206 on the end of member 200 engages lever contact means in the form of a striker 207, fixed to support 150, when arm 186 swings to its inner or forward position and thereby causes pins 205 to deflect the tube 54*b* as shown. Prior to this, however, the tube as indicated above, is bent downwardly as the cap 54*a* is positioned in the chuck 190, as shown in FIG. 13. When the arm 186 swings in the opposite direction (FIG. 15), the deflection of the tube to one side is accomplished and the cap and tube will be out of the way to permit the vertical movement of the fill-head 130 to move the nozzle 166 into and away from filling relationship with the spout 53.

Figure 3:
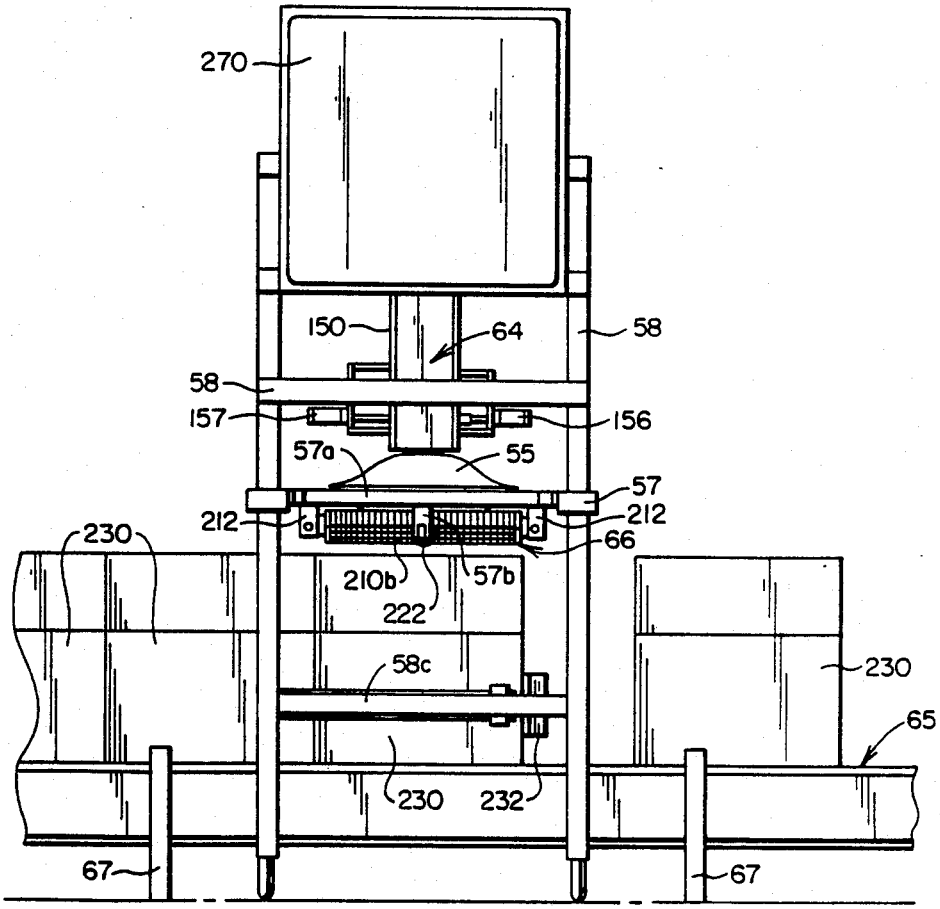
FIG. 3 is an elevational view at the discharge end of the machine.

At the time the bag is being filled, the spout-engaging jaws 153 and 154 are in engagement with the spout to hold it in a fixed horizontal and vertical position. As it is filled, the bag will expand downwardly as shown in FIGS. 1 and 3 to rest on the slideable drop table 66 so that there will be no undue force on the spout 53 or the bag 55.

This table is in the form of a roller platform and is shown best in FIGS. 1 to 3, 18 and 19, and consists of two opposed horizontally reciprocable half sections 210*a* and 210*b*, the section 210*a* being the front section and the section 210*b* being the back section. The section 210*a* is supported for sliding movement by shafts 215 carried at each side of the square horizontal frame section 57*a* on depending lugs 211 and 212 and the section 210*b* is supported similarly by shafts 215 from the square frame section 57*a*. Frame section 57*a* is secured to frame section 57 by angles 216. The sections 210*a* and 210*b*, when in a closed position meet at a transverse joint 210*c*. Each platform section is formed by a multiplicity of small rollers 214 as indicated best in FIG. 18 to provide a substantially friction-free support surface. These rollers are carried on transverse rods which are supported by side support plates 213. At the sides of the platforms 210, the longitudinal shafts 215 carry the platforms 210*a* and 210*b* by the slideable bearings 218 and these bearings are connected to plates 213 through plates 213*a*. The shafts 215 thus carry the platform sections 210*a* and 210*b* which support the filled bag 55 when closed and drop the filled bag 55 when open.

Sliding of the platform sections 210*a* and 210*b* on their respective shafts 215 through bearings 218 is controlled by a front cylinder and piston unit 221 and a back cylinder and piston unit 222.

The cylinder of each platform section is attached for vertical movement at 223 to a bracket support 57*b* extending from the frame section 57*a* at its longitudinal centerline. A limit valve LV11 is mounted on frame section 57*a* for engagement when the platform sections open outwardly so as to actuate cylinders of units 221 and 222 to return the platform sections to horizontal bag-supporting position. Each unit 221 and 222 has its piston rod 224 connected at 225 to a central connection bracket 214*a* attached to a platform section. As indicated, the platform sections 210*a* and 210*b* will be controlled by cylinders 221 and 222 to slide open the sections 210*a* and 210*b* outwardly to drop the filled bag 55, and then to close the sections inwardly to their horizontal bag-supporting position.

Figure 2:
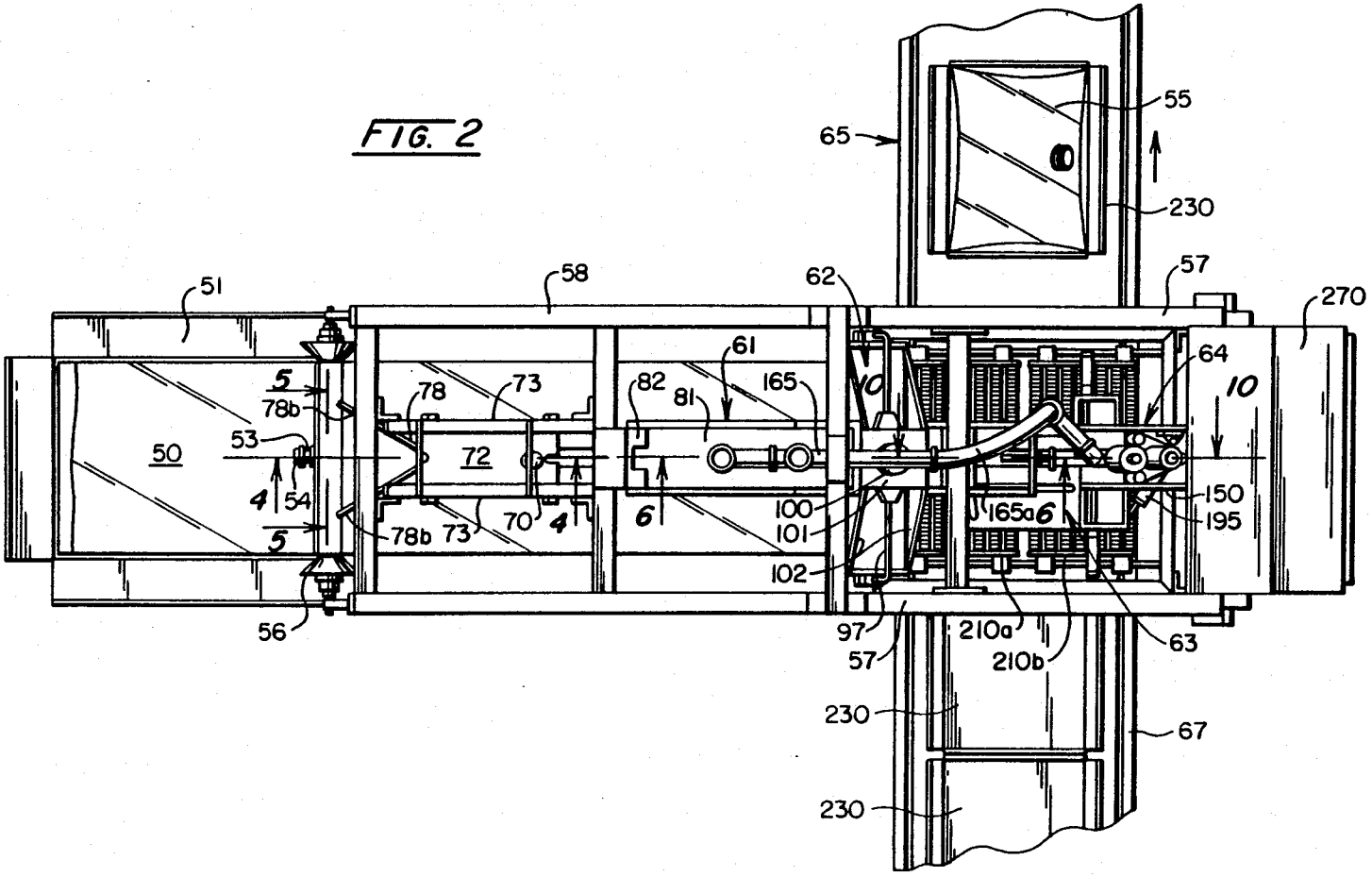
FIG. 2 is a plan view of the machine.

The filled bag may be dropped into a box or case 230 which is carried on the discharge conveyor 65 shown in FIGS. 1, 2 and 3. This conveyor is shown supported transversely below the frame 57 by the suitable support frame 67 previously mentioned. The conveyor may be driven continuously, or intermittenly, and will be supplied with a series of cases which will move successively into bag receiving position opposite a rail 231 (FIG. 1) supported above the conveyor by an upward extension 67*a* of frame 67. To hold the case in bag-receiving position, a stop 232 is moved into contact with the leading side thereof by a cylinder and piston unit 235 which is supported by a transverse frame section 58*c* (FIG. 3) carried on the lower portion of the main frame 58.

Figure 27:
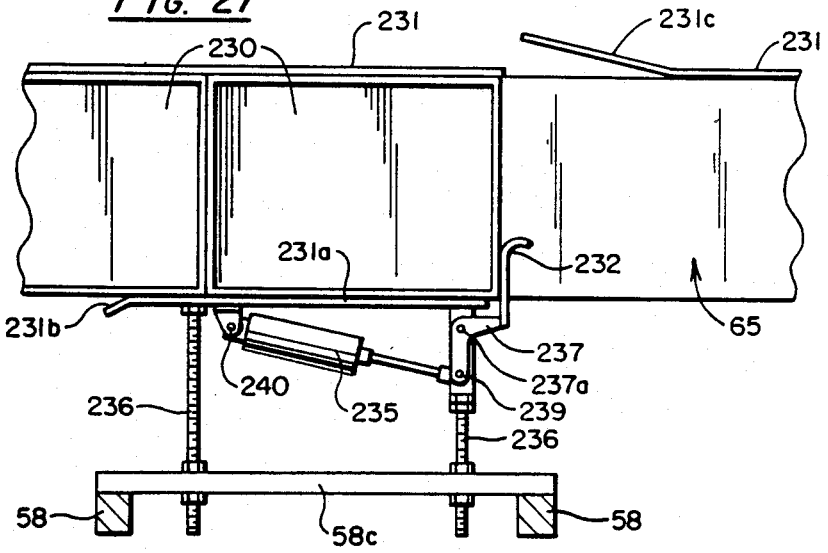
FIG. 27 is a horizontal sectional view taken along line 27—27 of FIG. 1 and FIG. 23 showing the box stop of the discharge conveyor.

The mechanism for operating the stop 232 is shown generally in FIGS. 1 and 3 and is the same mechanism as shown in FIG. 27 more in detail. Opposite the case guide 231 is a guide 231*a* which has an outwardly flared inlet end 231*b*. The guide 231 is carried by adjustable bolts 236 which extend inwardly from the support 58*c*. The stop 232 is carried by a bellcrank lever 237 pivoted at 237*a*. The, bellcrank lever 237 is pivoted at 239 to the piston rod of unit 235 and the cylinder of this unit is pivoted at 240 to the guide 231*a*. Thus, actuation of cylinder and piston unit 235 will pivot the stop 233 above pivot 237*a* to move it from case stopping position (FIG. 27) to releasing position. When the platform sections 210*a* and 210*b* are opened, they will drop a filled bag 55 into the case 230. As the case 230 passes the stop 232, it is moved laterally slightly by the case stop 232 closing to stop the next case 230 in line. This lateral movement is allowed by a section 231*c* of the guide 231. The cases 230 are straightened as they move along with the conveyor 65.

Instead of the discharge system shown in FIGS. 1 to 3, an alternative discharge system may be provided as shown in FIGS. 23 to 27. In this the case stop mechanism is the same as described above, but is carried by a lateral extension 582 of frame 58. Instead of the slideable trap door arrangement of the drop table 66 for supporting the bag 55 during filling, a single drop table in the form of a tiltable roller platform 66*a* is provided. This platform is pivoted at 241 to a vertical portion of the frame 58. It is moved between horizontal bag-supporting position and tilted discharge position by a cylinder and piston unit 245, which has a pivoted connection at 246 to the platform and a pivotal connection at 247 to the frame 58. The conveyor 65 is shown as being positioned transversely of the machine, but it can be positioned as desired to receive cased bags in any of four quadrants from under the platform 66. Any desired bag end may be leading as it is filled and discharged: i.e., the spout first or spout trailing and either edge of the bag first. The latter is especially helpful in inserting bags into side-loading boxes or cases. A limit control valve LV5 is provided on the frame 58 for engagement by the platform when it swings downwardly to control cylinder and piston unit 245 to return it to bag supporting position.

Figure 24:
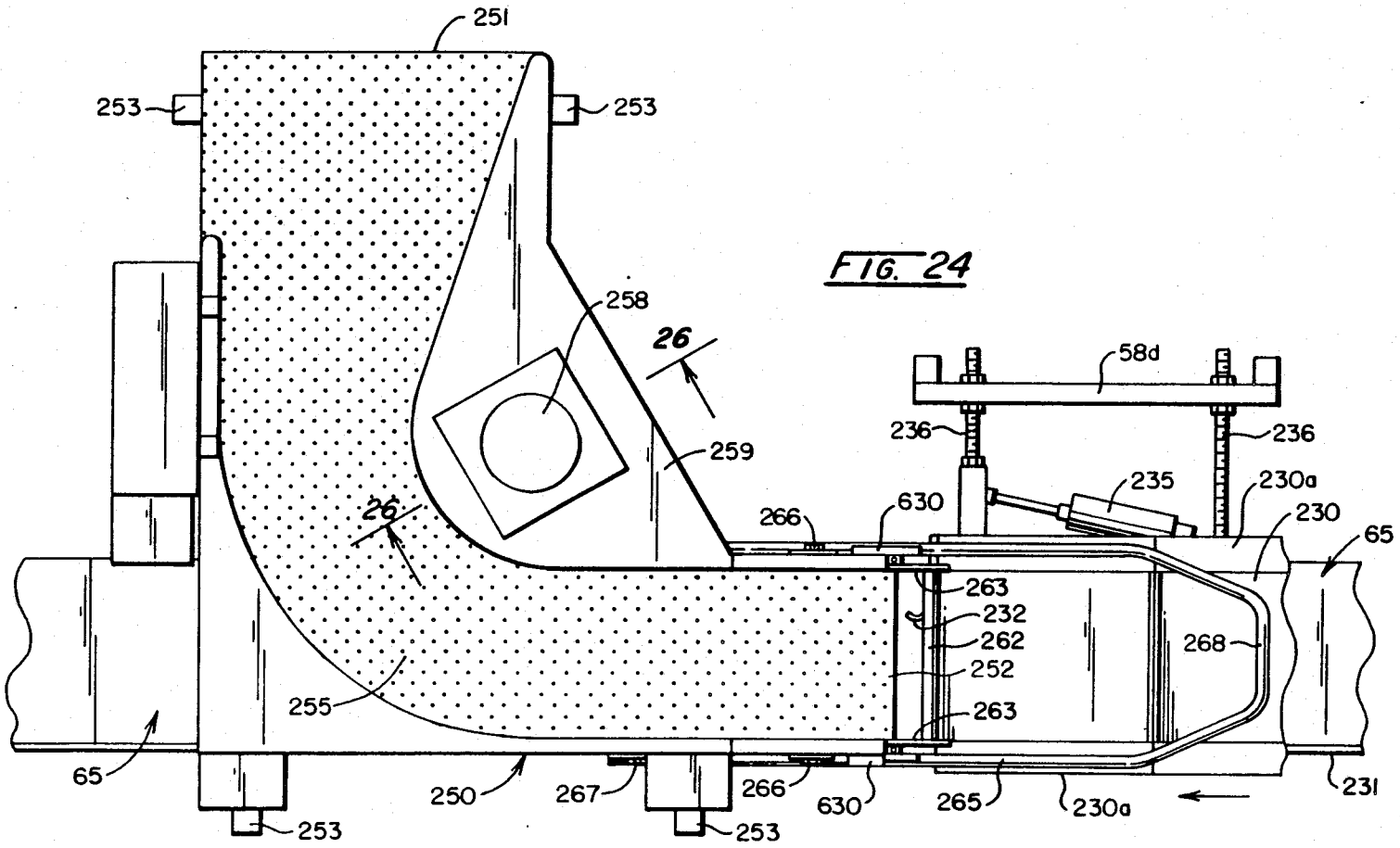
FIG. 24 is an enlarged top view of the bag discharge conveyor taken along line 24—24 of FIG. 23.
Figure 25:
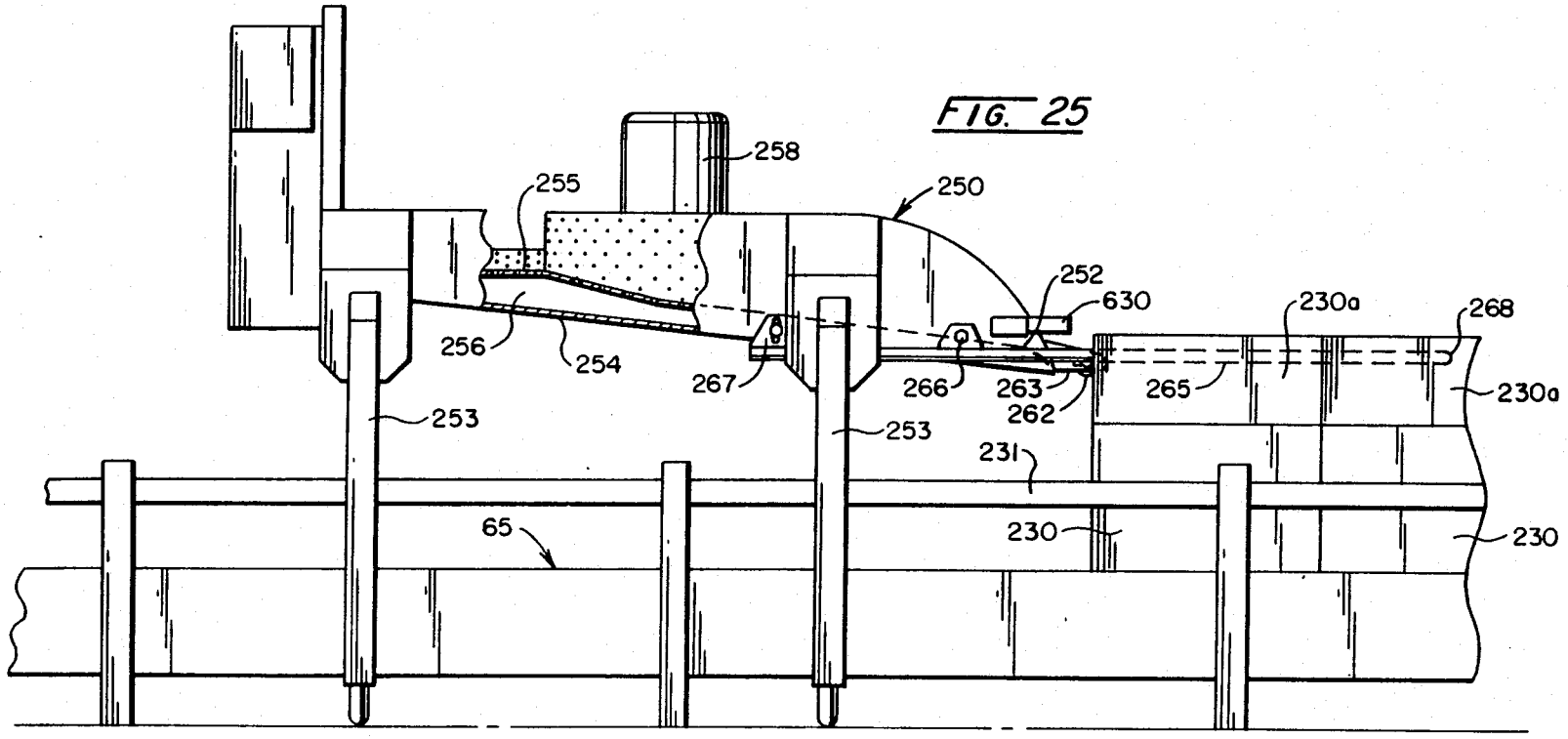
FIG. 25 is an enlarged elevational view of the bag discharge conveyor taken from the side of FIG. 23.
Figure 26:
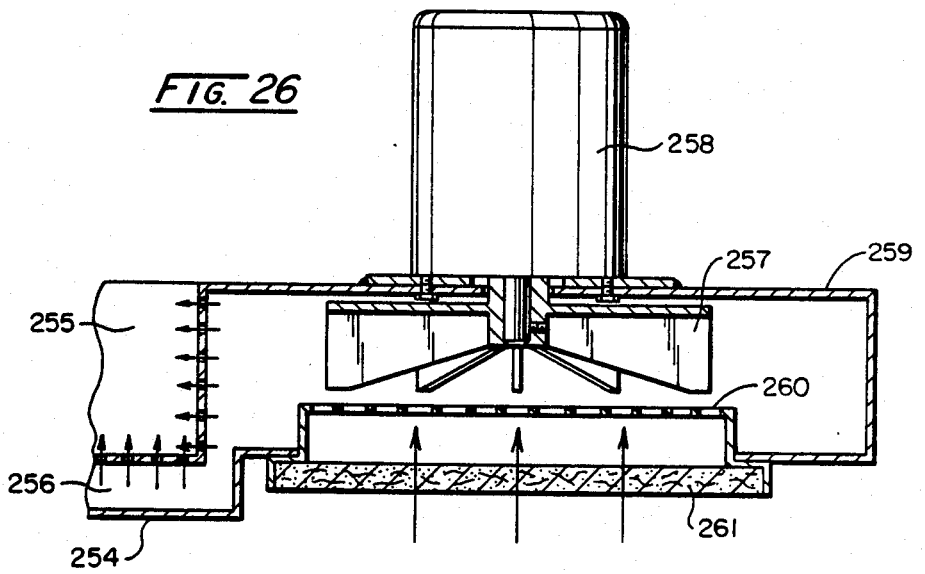
FIG. 26 is a vertical sectional view showing the blower of the discharge conveyor taken along line 26—26 of FIG. 24.

This optional discharge system is an air table 250 comprising a pneumatic conveyor system which receives the bag from the tilted platform 66*a* and carries it on a cushion of air to a stopped case 250 on the conveyor 65. This table is positioned under the horizontal frame section 57 and straddling the conveyor 5. Its inlet end 251 is directly below the discharge edge of tiltable prop table 66*a* and its discharge end 252 is over the conveyor 65. The air table 250 comprises a main support plate 254 which is imperforated and is carried by legs 253 to be inclined from the inlet end 251 to the discharge end 252. Above the plate 254 is the bag guiding and supporting chute 255 which is spaced above plate 254 to provide an air supply chamber 256. The entire bottom and sides of this chute 255 (FIG. 26) are perforated and the chute is flared to provide a wider inlet end 251 and gradually narrows to its discharge end 252. As shown in FIG. 24, the chute is of substantially L-outline in the plan. Air is supplied to the space 256 and is forced through the perforated chute walls by a blower 257 (FIG. 26) which has its drive motor 258 upstanding from the blower housing section 259. A perforated inlet wall section 260 is formed in the housing and has a filter 261 disposed in covering relationship thereto. This blower will operate continuously and will force air through the walls of the chute to provide by the upwardly directed jets an air cushion on which the bags will move as well as to center them in the chute as they move along due to the jets of air directed from the side walls.

At the discharge end 252 of the bag chute 255, a bag turning bar 262 is provided. This bar is a round. bar which is disposed transversely at a position just slightly above the chute discharge edge 252. This bar is carried by the brackets 263 at the end of the chute. Also at the end of the chute, is a projecting U-shaped bar 265 for spreading the side flaps 230*a* of bag-receiving cases 230 which are moved into position by the continuously moving conveyor 65. This member 265 is pivotally mounted on the chute 255 at 266 intermediate its length and at its rear end is connected to the chute by bolt and slot connections 267 to permit raising and lowering of its downstream end. This end is narrowed at 268 to facilitate entrance between the case flaps 230*a* of the cases being supplied by the conveyor 65 and moving into engagement therewith.

Thus, filled bags deposited into the inlet end of the chute 255 by the tilting drop table 66a will move along the inclined chute 255 supported and centered by the air jets coming through the perforated chute surfaces. The bags will travel successively to the discharging end 252 where the leading edge of each bag will engage the fixed transverse bar 262. This will flip the bag end-over-end and cause it to drop flat into the case 230 therebelow.

In initially loading, the first strip of bags 50 for starting the operation of the machine, the operator feeds a strip over the in-feed roller 56 and starts the first spout into track guides 78 and advances the strip until the first capped spout 53 is hooked by bail 90 of the strip-feed or long-feed pusher 61. The strip-feed or long-feed draws the strip along the support plate 80 to a point that registers the first perforated line 50a with the separator blade 95. The succeeding capped spout is registered with the cap seater 70. The separator 62 is actuated to separate the first bag while the clamps 114 and 114*a* hold the strip tightly as the blade 95 breaks through the perforated line 50*a*. The capped spout of the separated bag 55 is delivered by the long-feed 61 to a location where it will be very rapidly transferred by the separated bag-feed or short-feed 63 into the uncapping/capping mechanism directly under the fill-head 130. The pneumatic sensor 154*a* at the spout gripping jaws 153 and 154 detects the presence of the capped spout at the filling station and actuates the spout clamping, uncapping and filling cycles. As the cap is engaged by the cap chuck 190, it is lifted and pivoted out of the way on arm 186, and the fill-head 130 lowers and the filling commences with fill volume under the control of the turbine metering system. As soon as the fill is complete, the fill valve closes, the fill-head 130 rises, and the cap 54 is replaced on the bag spout 53 by reverse movement of arm 186. The arm 186 with chuck 190 pivots back, stripping the chuck from the cap. When back, the spout clamp jaws 153 and 154 then open or retract to release the filled bag which has been partially supported on the roller platform during filling. Simultaneously, the roller platform opens or tilts, depending on the option employed, and the filled bag is moved away by either of the discharge systems shown in FIGS. 1 to 3 or FIGS. 23 to 25. As soon as the capped bag clears the uncapper/capper, the following empty bag is transfered into it.

Figure 23:
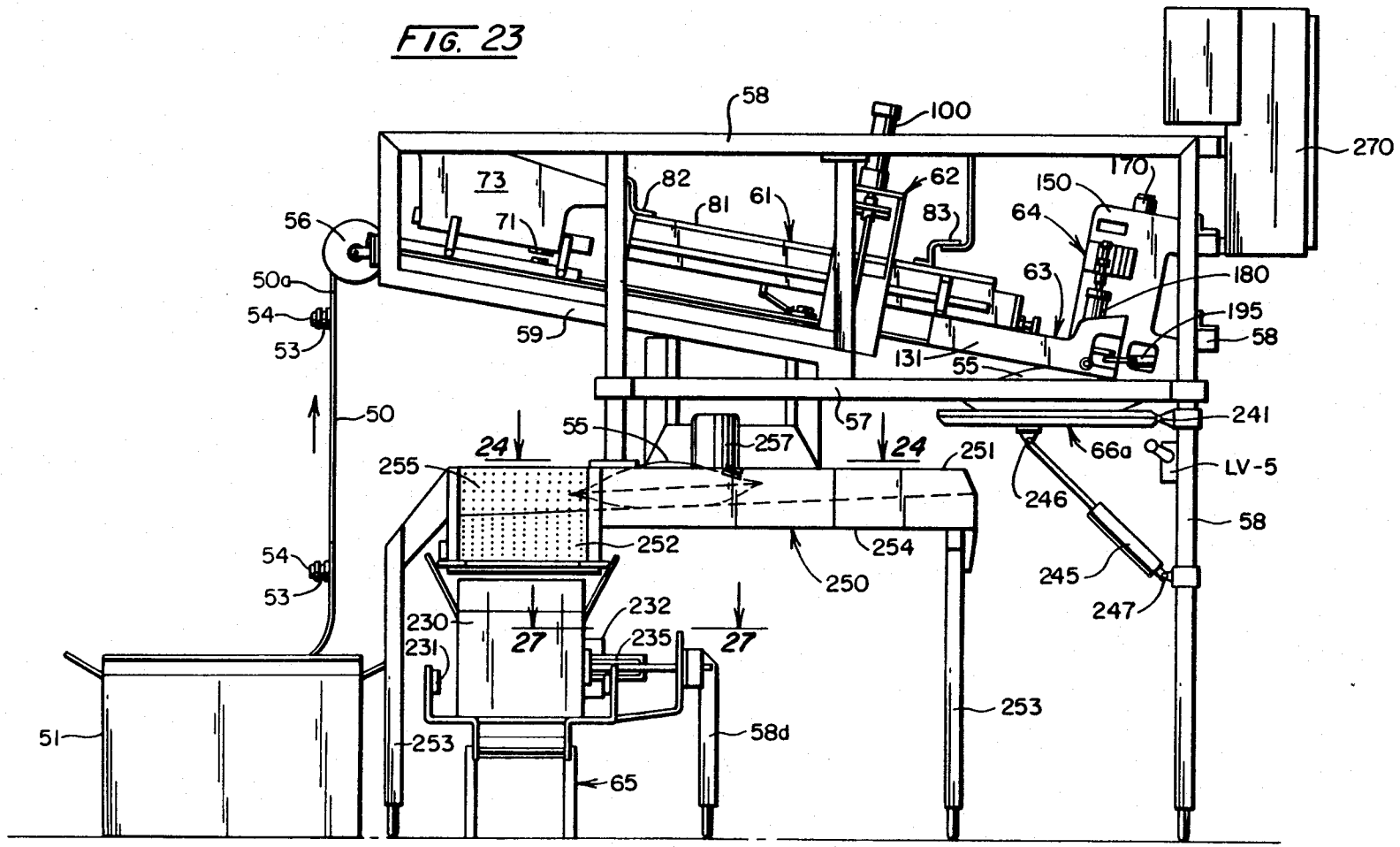
FIG. 23 is a side elevational view of an alternative embodiment of the bag discharge conveyor of the machine.

The pneumatic logic controls and electric circuits for the machine are disposed in a housing 270 supported on the main frame 58. (FIG. 1 and 23).

These control circuits include the following described elements which function in the manner indicated.

Figures 20A, 20D:
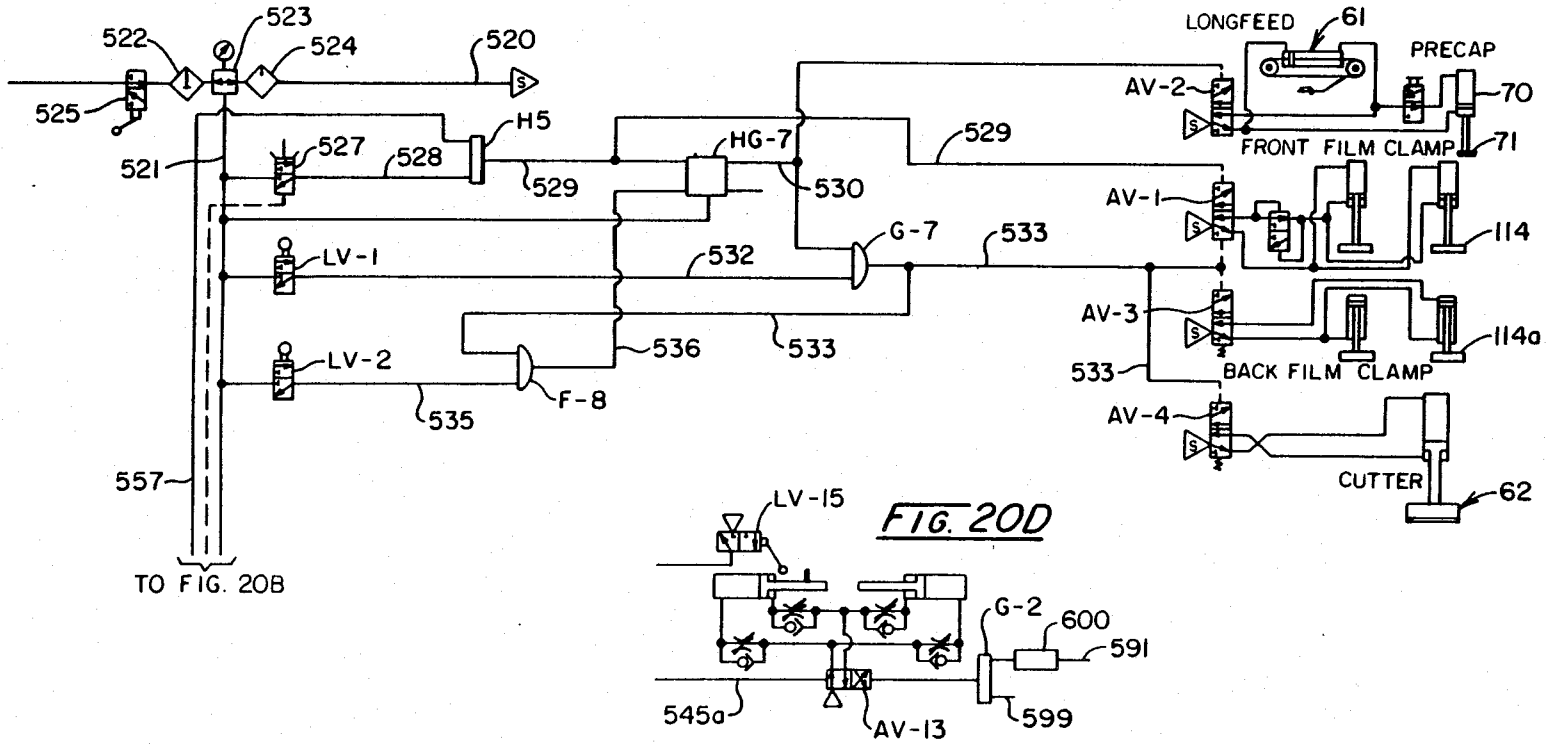
FIG. 20A is a diagram of part of the pneumatic logic system of the machine with symbols for the mechanisms operated by it.
FIG. 20D is a diagram of the pneumatic control system for the bag drop platform of the machine of FIG. 1.
Figure 20B:
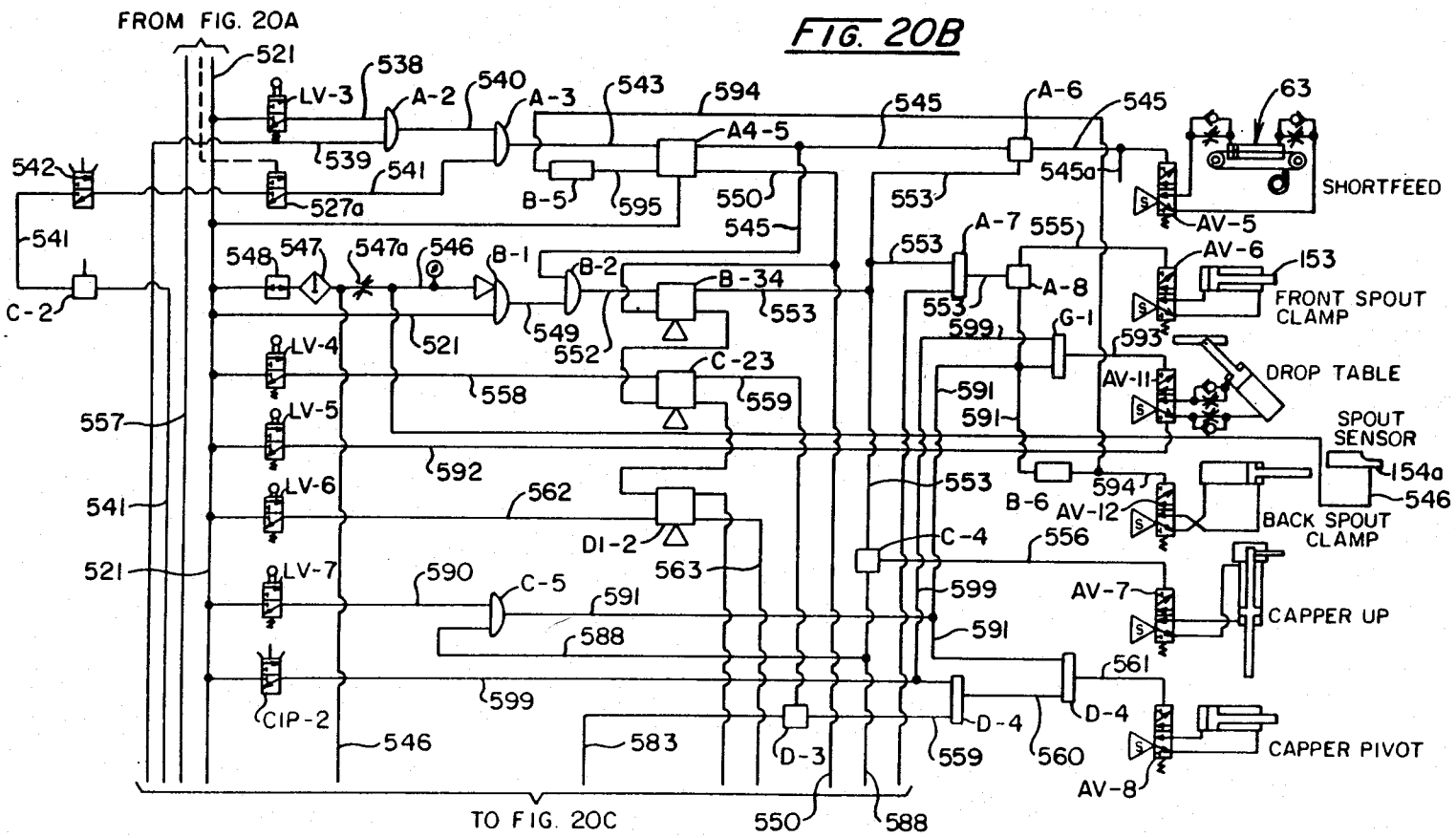
FIG. 20B is a continuation of the diagram of FIG. 20A.
Figure 20C:
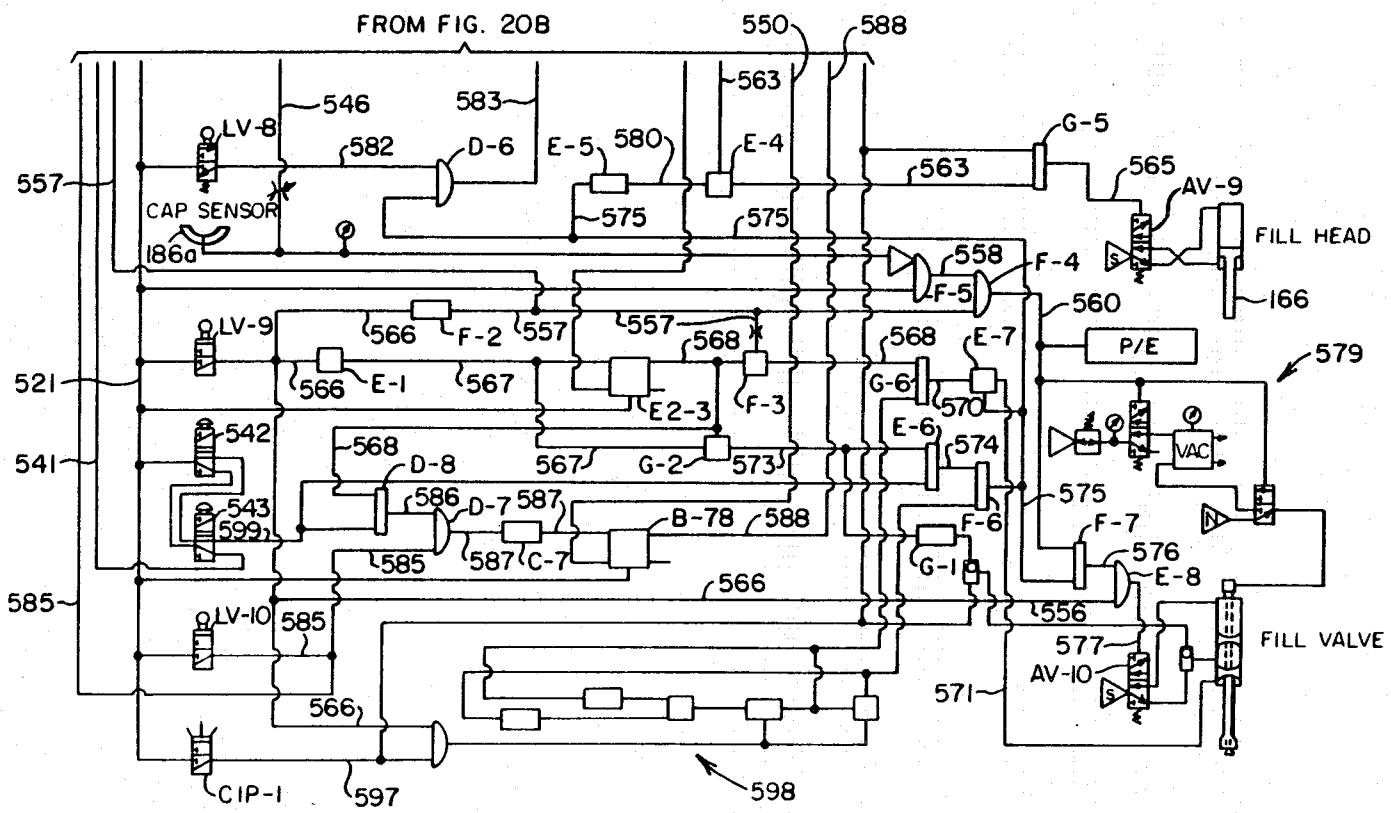
FIG. 20C is a continuation of the diagram of FIG. 20B.
Figure 21:
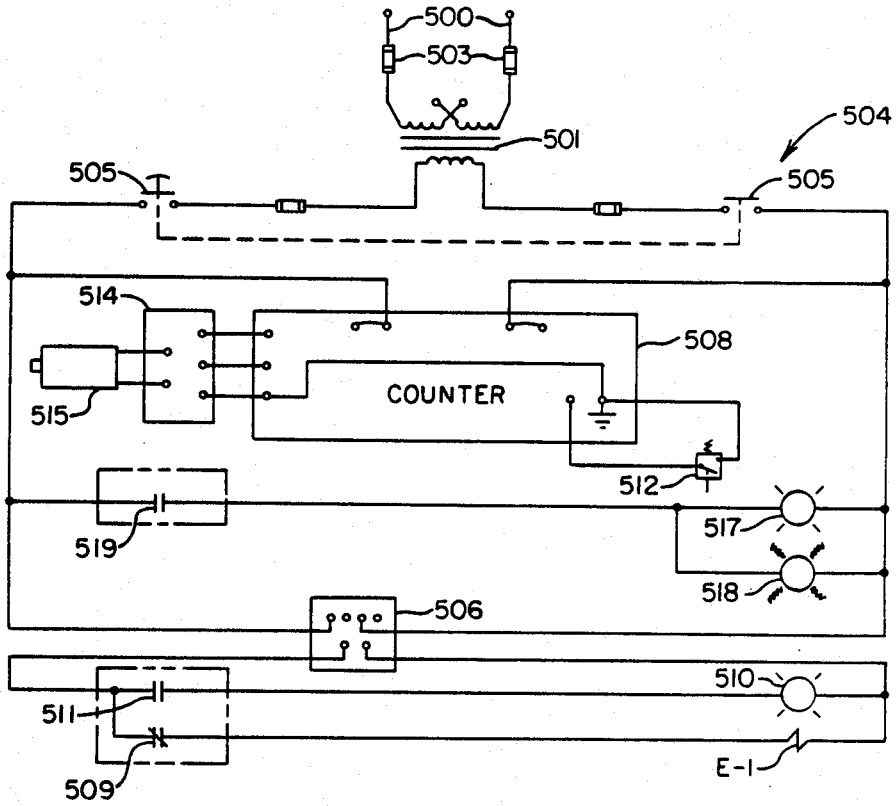
FIG. 21 is a diagram of the electrical circuit of the machine.

The pneumatic logic control circuit for controlling operation of the bag filler machine is shown in FIG. 20A, Figure 20B and FIG. 20C. An electrical circuit used in conjunction with the pneumatic circuit is shown in FIG. 21. This electrical circuit includes leads 500 from a suitable power source. The leads 500 connect to a step-down transformer 501, through protective circuits 503, to provide voltage for the main section 504 of the circuit on the machine. The double-pole switch 505 controls reduced voltage from transformer 501. The main circuit 504 includes a low-voltage power supply 506 of a suitable type which supplies a voltage to counter 508 which can be of various commercially available types, such as the dual preset 6 digit electronic control manufactured by Durant. The low voltage power supply 506 provides power for solenoid air valve El and fill complete light 510 under control of internal relay contact 509 of counter 508. Fill complete light 510 is controlled by the contact 511 of counter 508 and is also supplied by the low-voltage power supply 506. The counter is reset by a pressure switch 512 controlled by the pneumatic logic circuit. The solenoid air valve E1 controls the air cylinder 170 of the fill-head 130. Connected to the counter 508 to provide an input signal thereto is the signal conditioner 514.

The signal conditioner 514 is also of a common type, one source being Durant. The signal conditioner 514 receives input from a digitizing flow meter 515 of common type which provides a signal in accordance with the volume of liquid flowing therethrough. The shape of the electrical impulse generated by the meter is altered by signal conditioner 514 to make the pulse better adapted to the input characteristics of the electronic counter. The volume flow meter 515 used may be of the turbine type, oscillating piston type or electronic type. As indicated, one type found very suitable is the turbine type known as "Invalco 1" Digitizing Turbine Meter. This meter 515 is interposed in the supply line 165 which supplies liquid to the fill-head 130. Contact 509 of counter 508 opens when fill is complete and contact 511 of counter 508 closes when fill is complete, lighting lamp 510.

This counter has other useful features, one of which signals or stops the filling operation when a pre-set number of bags has been filled. The feature is called batch counting and is indicated by lamp 517 and horn 518 controlled by contact 519 of counter 508. Contact 519 closes when batch is complete. The counter.also has outputs (not shown in drawings) that will interface with most computer systems to allow virtually unlimited control and printout arrangements.

Specifically referring to the pneumatic logic control system shown in FIG. 20A, FIG. 20B and FIG. 20C, compressed air to the bag filling machine is separated into lubricated and non-lubricated branches 520 and 521 through filter 522, regulator 523 and lubricator 524. Lubricated air 520 supplies all air cylinders and other devices requiring lubrication. Non-lubricated air 521 supplies the logic system. A hand lever operated air shut-off and exhaust valve 525 is mounted on the machine in a suitable location. It cuts off air to all mechanisms and exhausts it so that those mechanisms can be moved manually for set-up purposes or in clearing jams.

It will be noted that lubricated air is shown by the symbol ⊳ and non-lubricated air to the logic comes off air line 521. The following outlines the major portion of a complete cycle and assumes the preceding cycle is complete, i.e., air logic *reset* has occurred and the reset line 550 is pressurized. The bags are fed into the machine from the box that carries a continuous strip of bags 50. This continuous strip of bags is fed over the in-feed roller 56 into the spout guides 78 and is pulled forward until the first spout is hooked into long-feed pusher as previously described.

In the following logic control explanation, the basic logic functions of "and", "or", "not", etc. are identified by the prefix to the module designation; for example, the "and" module 538 in the upper left hand location of Figure. 20B will be called out in the text as AND A-2, etc.

To start up, the operator momentarily turns select or run-off-manual long-feed valve 527 to manual and sends a pulse output on line 529, which pilots valve AV-1 raising the front strip clamp 114. Output on line 529 also switches Flip Flop HG-7 producing an output on line 530 which pilots valve AV-2 which sends the long-feed 61 forward, cap seater 70 down, and positions the first bag for the separator 62. Limit valve LV1 is activated when the long-feed 61 is forward, producing an output on line 532, and in conjunction with output on line 530 through AND G-7, produces an output on line 533 piloting valve AV-1 and valve AV-3, causing front and back film clamps to close. An output on line 533 also pilots valve AV-4 sending the cutter or separator blade 95 up separating the leading bag from the continuous strip of bags. Limit valve LV2 is activated when the blade 95 is up, producing an output on line 535. Outputs on line 535 and line 533 activates AND F-8 which resets Flip Flop HG-7 through line 536, returning blade 95 down and then long-feed pusher 61 back, pre-cap unit up and raising back strip clamp 114*a*. The separated bag is now ready to be pushed into the uncapping/capping station. When the long feed pusher returns, it operates valve LV3 (FIG. 20E) that produces an output signal on line 538. Pressure signal on line 538 and 539 activates AND A-2 producing signal on line 540. Signal on line 539 is produced when the uncapper/capper is forward operating valve LV10. AND A-3 produces signals on line 540 and line 541. Signal on line 541 is made through manual stop valves 542 and 543, through NOT C-2, later discussed in FIG. 28A, through optional filler OFF-RUN valve 542 and RUN-OFF-MANUAL long-feed valve 527*a*. When AND A-3 is made, it produces and output on line 543 to operate Flip Flop A4-5. Flip-Flop A4-5 produces an output signal on line 545 through NOT A-6 that pilots AV-5 sending the short-feed pusher 63 forward pushing the capped spout into the uncapped capper. The presence of a spout and cap against the spout sensor 154*a* and cap sensor 186a restricts air flow and builds back pressure to produce an output on line 546. Filter 547 and regulator 548 supply regulated air pressure to restrictor 547A. AND B-1 is activated by signals on line 547 and line 521 producing an output on line 549. AND B-2 is activated by signals on lines 543 and 549, previously described, to produce an output signal on line 552 to operate Flip Flop B-34 producing an output on line 553. Signal on line 553 shuts off NOT A-6 allowing AV-5 to shift returning short-feed 63. Signal on line 553 also activates OR A-7 and NOT C-4 output from OR A-7 passes through NOT A-8 producing an output on line 555, which pilots AV-6 sending the front clamp 153 to firmly grip the spout. The signal on line 553 also passes through NOT C-4 producing an output on line 556, which pilots AV-7 which lifts the capper up and removes the cap 54 from the spout 53. When the uncapper/capper is up, it operates valve LV-4 to produce an output signal on line 558 to shift Flip Flop C-23 producing an output on line 559. Output on line 559 passes through NOT D-3 activating OR D-4 and producing an output on line 560. Output 560 activates OR D-5 that produces an output on line 561. Output on line 561 pilots valve AV-8 pivoting the uncapper/capper back. When it swings back, it operates limit valve LV-6 producing an output on line 562. Output on line 562 shifts Flip Flop Dl-2 to produce an output on line 563. Signal on line 563 passes through NOT E-4 (FIG. 20*c*) and operates OR G-5 producing an output on line 565. Signal on line 565 pilots AV-9 that lowers the fill-head nozzle 166 into the spout. When the fill-head is down, it operates limit valve LV9 producing an output on line 566. Output on line 566 operates PULSE F-2 producing a momentary signal on line 557 and in conjunction with the cap sensor 184*a* and spout sensor 154*a*, actuates AND F-5 producing a signal on line 558 to operate AND F-4. AND F-5 has input signals on line 546 and supplyline 521 as previously described. When AND F-4 produces an output signal on line 560, it operates a pressure-electrical switch 512, previously described in FIG. 21, resetting the counter to zero. Also, when an output signal is on line 557 at this time, it also operates OR H-5 that starts the long-feed cycle, previously described, sending the next bag with capped spout forward to be separated. Output on line 566 also supplies solenoid E-1 of normally-closed valve which is energize,,d by the counter being reset to zero, also previously described with reference to FIG. 21. When solenoid E-1 is energized, a signal is produced on line 567 shifting Flip Flop E2-3 producing an output on line 568 that passes through NOT F-3 to OR G-6 and produces an output on line 570, which passes through NOT E-7 producing an output on line 571 which pilots valve AV-10 opening the fill valve to let product into bag. When counter preset is reached on completion of fill, the solenoid E-1 is de-energized, signal is lost on line shutting OFF output from NOT G-2 losing signal on line 573 and input to OR E-6, thereby losing signal on line 574 and simultaneously shifting OR F-6 preventing a signal on line 575. No signal on line 575 to OR F-7 shuts off signal on line 576. AND E-8 is operated when there.is an output on line 576 and line 5566, as previously described. When AND E-8 is operated, it produces an output on line 577 piloting valve AV-10 that closes the fill valve. The optional vacuum nitrogen system 579 evacuates the bag before filling and caps off the bag with nitrogen after the filling. Output on line 575 also goes to timer TIM E-5 and after a short delay, produces an output on line 580 that shuts off NOT E-4, which allows valve AV-9 to raise the fill nozzle 166 out of the spout. With the fill-head 130 up, valve LV-8 is operated producing a signal on line 582 and in conjunction with a signal on line 575 to AND D-6, produces an output on line 583 shutting off NOT D-3 allowing valve AV-8 to pivot uncapper/capper over the spout. When uncapper/capper swings forward, it operates valve LV-10 producing a signal on line 585. Signals on line 585 and line 586 operates AND D-7 that produces an output signal on line 587. Signal on line 586 is produced through line 568, previously described, and OR D-8. Output signal on line 587 passes through PULSE C-7 shifting Flip Flop B7-8 producing an output signal on line 588. Signal on line 588 shuts off NOT C-4, shifting valve AV-7 to put the cap 54 down on the spout 53. When the capper moves down, it operates valve LV-7 producing an output on line 590. Signal on line 590 in conjunction with signal on line 588 operates AND C-5 producing an output on line 591. Signal on line 591 passes through to OR D-5 producing an output on line 561 and shifts valve AV-8 that pivots the uncapper/capper back away from the capped bag 50. Also, signal on line 591 goes through OR G-1 to produce an output on line 593 and shifts valve AV-11, which lowers the tilt drop table 66*a* (FIG. 23). When the drop table 66*a* lowers, it operates valve LV-5 producing an output on signal line 592 shifting valve AV-11 tilting the discharge table 66*a* up to the bag filling position. At this same time, signal on line 591 shuts off NOT A-8 releasing the front spout clamp 153. Signal on line 592 also operates delay B-6 producing an output signal on line 592 shifting valve AV-12 that retracts the back spout clamp 154 releasing the bag 55 into the case 230. Signal on line 592 also operates DELAY B-5 producing a delayed signal on line 595 that resets the Flip Flop chain through line 500 and readying the cycle for starting over. The manual selector valve CIP-1 produces an output on line 597 which energizes the clean-in-place oscillator circuit 598. This circuit opens and closes the fill valve for cleaning on an adjustable cleaning cycle to clean-in-place. Valve CIP-2 is also part of the clean-in-place circuit. Valve CIP-2 produces an output on line 599. Stop valves 542 and 543 produce an output on line 599 that will immediately stop the fill and return the machine to the start-up mode. It will be noted that this circuit incorporates the tiltable drop table 66*a* of FIG. 23. The circuit for the slideable trap door drop table 66 of FIG. 1 is shown in FIG. 20D. Signal on line 591 through DELAY 600 operates OR G-2 that shifts valve AV-13 opening the trap door drop table 66. Signal on line 545*a* shifts valve AV-13 closing the slideable trap door drop table 66. When the trap door drop table opens, it operated valve LV-15 shown in FIG. 20D, FIG. 19 and FIG. 22.

Figure 22:
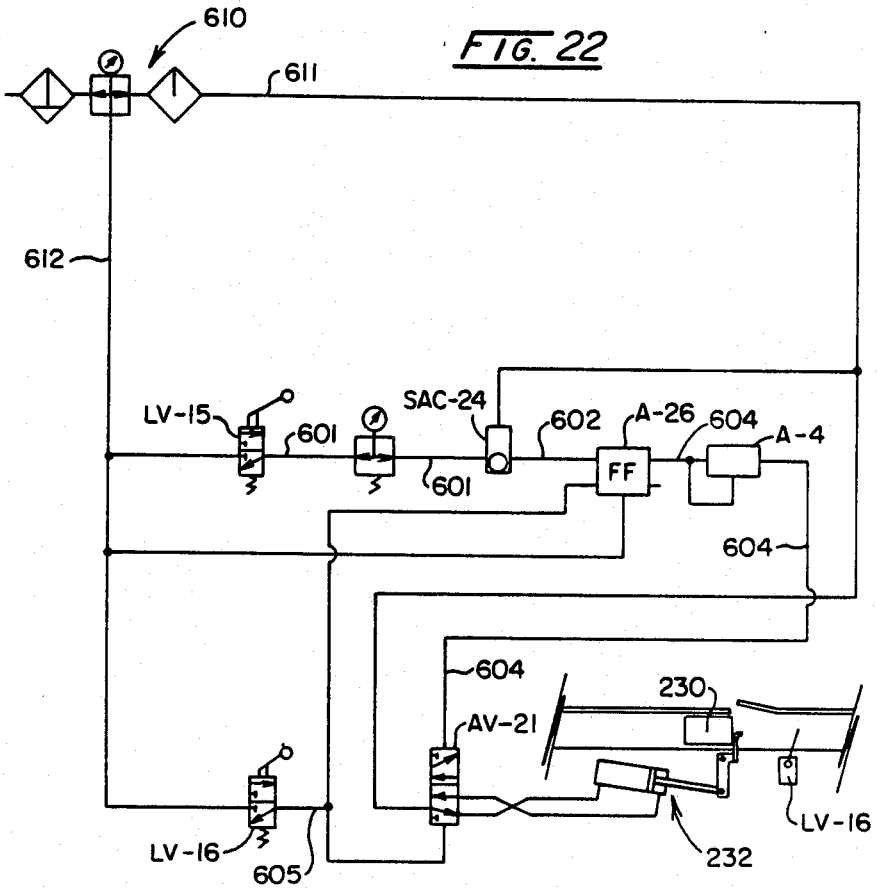
FIG. 22 is a diagram of the pneumatic logic system of the case-stop of the discharge conveyor.

Referring now to FIG. 22, there is shown a circuit for the case stop 232 of the conveyor system of FIG. 1. Valve LV-15 produces an output signal on line 601, which is registered in the SAC-24 counter. The purpose of the counter is to count the bags going into each container or case 230. When the count set valve is reached, it produces an output on line 602 shifting Flip Flop A-26 which produces an output on line 604. Signal on line 604 operates DELAY A-4 and shifts valve AV-21 releasing the case stop 232. The case 230 moves to limit valve LV-16, which when operated, produces an output on line 605 shifting Flip Flop A-26 and valve AV-21, extending the case stop 232 and stopping the next case 230 in bag-receiving position. Air supply 610 supplies lubricated air to lines 611 and non-lubricated air to line 612 in this circuit. The conveyor 65 under the case runs continuously.

Figure 22A:
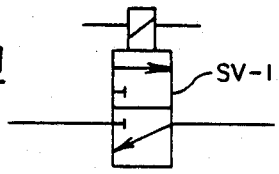
FIG. 22A is a diagram of a solenoid valve controlled by the photo switch of FIG. 28.
Figure 28:
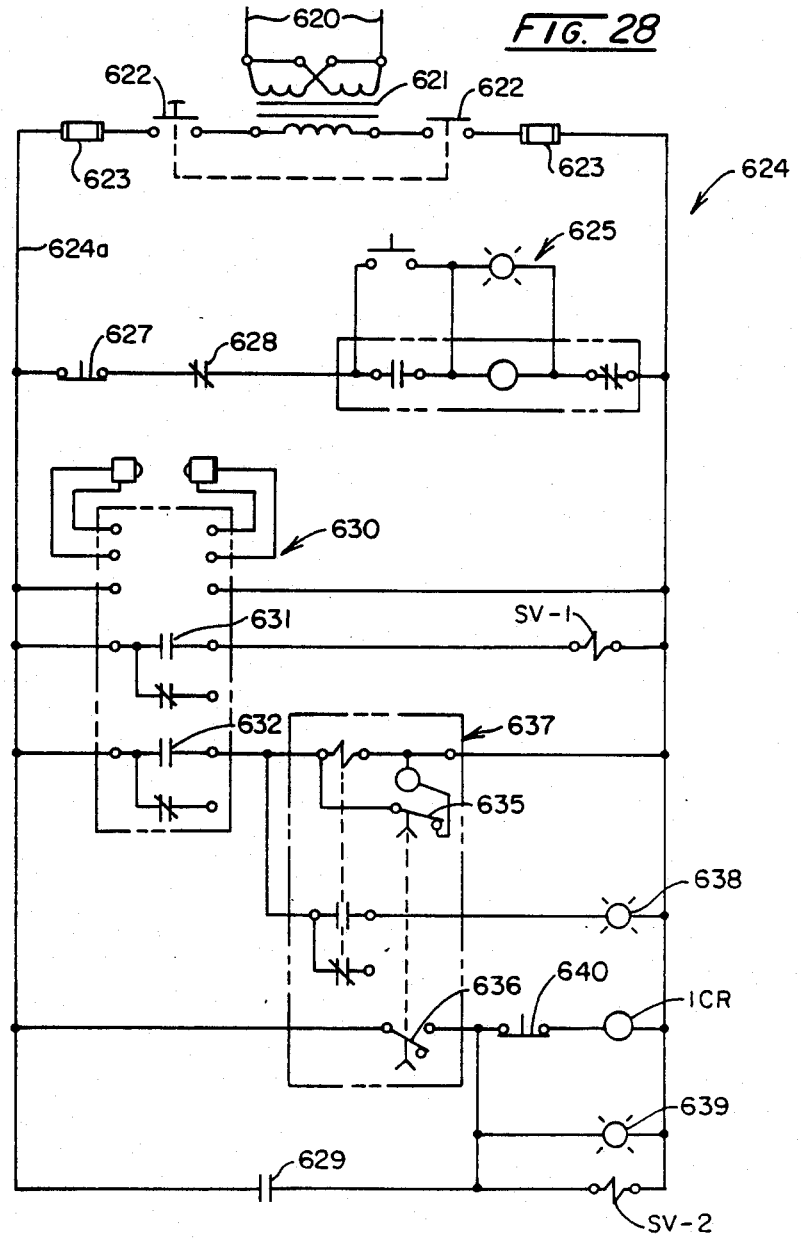
FIG. 28 is a diagram of the electrical circuit of the air table discharge conveyor section.
Figure 28A:
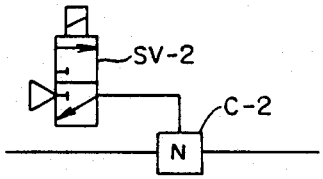
FIG. 28A is a diagram of a solenoid valve controlled by the time of FIG. 28.

FIG. 22A is a diagram of a solenoid valve SV-1 that replaces limit valve LV-15 previously described in FIG. 22. This replacement is the only change in the circuit used in the conveyor and stop system in FIG. 23. An electrical circuit used in conjunction with solenoid valve SV-1 of FIG. 22A is shown in FIG. 28. This electrical circuit includes leads 620 from a suitable power source. The leads 620 connect to a step-down transformer 621 to provide reduced voltage to the circuit. The double-pole switch 622 controls reduced voltage through fuse circuit protectors 632 from the transformer 622. Placed across the main circuit 624 are magnetic starter circuit 625,relay contacts 628 and stop switch 625, that control the conveyor motor and blower motor 257 of the air table 250 of FIG. 24. Starter circuit 625 is controlled by manual stop switch 625 and contacts 628 of the relay ICR. Located across the discharge end of the air table is a light beam and photo eye 630 (FIG. 24). As the filled bag is straightened and loaded into the container or case 230, the light beam to the photo eye 630 is broken, closing a set of contacts 631 and 632 energizing SV-1 solenoid previously described. If this set of contacts 631 and 632 remain closed too long, indicating ajam in loading, a set of timed contacts 635 and 636 of the time 637 shuts down the filler operation through solenoid valve SV-2 (FIG. 28A), shutting off NOT C-2 previously described. Lamp 638 indicates a bag 50 in the discharge table 250. Lamp 639 indicates a bag jammed in the discharge table. Relay ICR carries contacts 628 for starting and stopping the conveyor 65 and blower motor 257. Relay ICR also carries contacts 629 for holding solenoid valve SV-2 energized until the manual switch 640 is pushed resetting the circuit.

It will be apparent from the above description that this invention provides a bag filler machine which will accommodate a continuous strip of capped bags to separate, uncap, fill and recap successive bags. The machine has an uncappr/capper unit which will act on that type of cap which carries a flexible tube. The machine rs adjustable to accommodate widely varying bag dimensions. One of the machine's most important feature is its handling of the strip and bags by the long and short-feed sections without crunching or wrinkling which would be detrimental to the barrier properties of some bag fill structures. The bags are transferred gently and lie flat continuously. Firm clamping occurs at the separator. Also, during filling, each bag is supported bodily and not suspended only by the spout. Stress on the strip and separated bag is practically eliminated. The discharge of filled bags is highly variable to meet installation requirements in a variety of applications. With a short discharge conveyor, bags can discharge in any of four quadrants from under the machine or alternately, bags can discharge directly from the filling platform in any of the four quadrants with any desired bag edge leading. The pneumatic logic system which controls the various operations of the machine is of an environment-proof type which makes the machine suitable for operation in the normally wet conditions found in liquid-fill productions lines.

We claim:

1. In a machine for filling a container having a spout with a friction cap removable by pulling it frictionally off the spout and the cap carries a flexible tube projecting upwardly therefrom, said machine including a fill-head nozzle and means for locating the spout below the nozzle in axial alignment with the nozzle spaced below the fill-head nozzle, the fill-head nozzle and spout-locating means being relatively axially movable to permit engagement during filling, a support arm carrying a cap-engaging chuck, the arm being pivoted for horizontal swinging movement between the axially-spaced spout and the nozzle; the improvement comprising tube-bending means on the arm to engage the tube and bend it downwardly into a substantially horizontal position as the cap is engaged with the chuck, and tube-deflecting means pivotally carried on the arm for swinging movement into a tube-deflecting position as the arm swings with the chuck-engaged cap so as to deflect the tube laterally to one side of the fill-head nozzle and spout axis as the two are engaged during filling through the spout.

2. The combination of claim 1 in which the tube-deflecting means comprises a bellcrank lever pivoted to the arm adjacent the chuck for horizontal swinging movement and having tube-engaging means, resilient means normally holding the lever on the arm in a tube non-engaging position, and contact means supported adjacent the path of swing of the arm as it moves away from the axis of the aligned fill-head and spout for engaging the lever and moving the tube-engaging means into tube-engaging position.

3. The combination of claim: 2 in which the bellcrank lever is pivoted to the arm at its rear edge and extends forwardly over the arm with a tube-engaging member extending downwardly therefrom.

4. The combination of claim 3 in which the chuck has a socket for receiving the cap as it is moved horizontally thereinto and the tube-bending means is on the chuck.

5. The combination of claim 4 in which the resilient means comprises a spring connected between the rear end of the lever and the arm to swing it about its pivot and the lever contact means comprises a lug on a fixed support for engaging with a notch in the rear end of the lever adjacent its pivot.

6. A machine for filling a container having a spout which carries a friction cap removable by pulling it off the spout and of the type carrying a flexible tube projecting axially therefrom a fill-head, and means for supporting the fill-head and spout axially-spaced but for relative axial movement into cooperation for filling, a support carrying a cap-engaging chuck movable transversely of the path of the axial movement, said support carrying means to engage the tube and bend it downwardly as the cap is engaged by the chuck, and means on the support movable into tube-deflecting position during the transverse movement away from the spout with the engaged cap so as to deflect the tube to one side during filling.

7. A machine according to claim 5 in which the chuck has a socket for receiving the cap as it is moved transversely thereinto, and the tube-beinding means is on the chuck.

8. The combination of claim 7 in which the tube-deflecting means comprises a bellcrank lever pivoted to the support adjacent the chuck for swinging movement relative thereto, resilient means for normally holding the lever in a tube non-engaging position, and lever contact means adjacent the path of movement of the support as it moves away from the axis of the aligned fill-head and spout for engaging the lever and moving the tube-engaging means into tube-deflecting position.

9. The combination of claim 6 in which the fill-head and spout are supported in vertically-spaced relationship and the chuck support is in the form of an arm pivoted for horizontal movement between a position where the chuck is between the spout and fill-head and a position laterally thereof said chuck having a horizontally-opening socket for receiving the cap upon horizontal movement thereinto, and means for moving the spout horizontally to position the cap in the socket with the fillhead and spout axially-spaced vertically.

10. The combination of claim 9 in which the tube-bending means is on the cap chuck and engages the tube as the cap is moved forwardly horizontally into the socket to bend it rearwardly into substantially horizontal position.

11. A machine for filling a container having a spout which carries a friction cap removable by sufficient axial pressure and of the type carrying a flexible tube projecting axially therefrom, a fill-head and means for supporting the fill-head and spout on an axis but for relative axial movement into cooperation for filling, a cap-chuck-carrying support movable transversely of the said axis, and a tube bender and deflector on the support for engaging the tube as the cap is engaged by the chuck to first bend it laterally of the axis and then upon transverse movement of the support to deflect it laterally away from the axis.

* * * * *